US009499873B2

(12) United States Patent
Saitoh et al.

(10) Patent No.: US 9,499,873 B2
(45) Date of Patent: Nov. 22, 2016

(54) STEEL PLATE HAVING YIELD STRENGTH OF 670 TO 870 N/MM$^2$ AND TENSILE STRENGTH OF 780 TO 940 N/MM$^2$

(71) Applicant: NIPPON STEEL & SUMITOMO METAL CORPORATION, Tokyo (JP)

(72) Inventors: Naoki Saitoh, Nagoya (JP); Mitsuru Sawamura, Tokai (JP); Katsumi Kurebayashi, Tokai (JP); Yasunori Takahashi, Tokai (JP); Takumi Miyake, Tokai (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/422,496

(22) PCT Filed: Dec. 3, 2013

(86) PCT No.: PCT/JP2013/082501
§ 371 (c)(1),
(2) Date: Feb. 19, 2015

(87) PCT Pub. No.: WO2014/103629
PCT Pub. Date: Jul. 3, 2014

(65) Prior Publication Data

US 2015/0247214 A1 Sep. 3, 2015

(30) Foreign Application Priority Data

Dec. 28, 2012 (JP) ..... 2012-287666

(51) Int. Cl.
*C22C 38/44* (2006.01)
*C22C 38/46* (2006.01)
(Continued)

(52) U.S. Cl.
CPC ..... *C21D 1/30* (2013.01); *C21D 6/004* (2013.01); *C21D 8/02* (2013.01); *C21D 9/46* (2013.01); *C21D 9/50* (2013.01); *C21D 9/505* (2013.01);
(Continued)

(58) Field of Classification Search
None
See application file for complete search history.

(56) References Cited

U.S. PATENT DOCUMENTS 6,245,290 B1 6/2001 Koo et al.
2010/0032062 A1 2/2010 Yao et al.

FOREIGN PATENT DOCUMENTS

CN 1936055 3/2007
CN 101680068 3/2010
(Continued)

OTHER PUBLICATIONS

Office Action of Sep. 15, 2015 in related Chinese Application No. 201380044201.5 [with English Translation of Search Report].
(Continued)

*Primary Examiner* — Deborah Yee
(74) *Attorney, Agent, or Firm* — Birch, Stewart, Kolasch & Birch, LLP

(57) ABSTRACT

In a steel plate according to the present invention, a chemical composition is within a predetermined range, an α value is 0.13 to 1.0 mass %, a β value is 8.45 to 15.2, an yield strength is 670 to 870 N/mm$^2$, a tensile strength is 780 to 940 N/mm$^2$, an average grain size at ½t of the steel plate is 35 μm or less, and a plate thickness is 25 to 200 mm. In the steel plate according to the present invention, in a case where SR is performed on the steel, a charpy absorbed energy at −40° C. in an area in which SR is performed may be 100 J or more.

6 Claims, 2 Drawing Sheets

(51) Int. Cl.

| | |
|---|---|
| ***C22C 38/54*** | (2006.01) |
| ***C21D 1/30*** | (2006.01) |
| ***C21D 8/02*** | (2006.01) |
| ***C22C 38/00*** | (2006.01) |
| ***C21D 6/00*** | (2006.01) |
| ***C21D 9/50*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/50*** | (2006.01) |
| ***C21D 9/46*** | (2006.01) |

(52) U.S. Cl.

CPC ..... *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/50* (2013.01); *C22C 38/54* (2013.01); *C21D 2211/002* (2013.01); *C21D 2211/008* (2013.01); *Y10T 428/12* (2015.01)

(56) References Cited

FOREIGN PATENT DOCUMENTS

| | | |
|---|---|---|
| CN | 102459656 | 5/2012 |
| EP | 1435399 A1 | 7/2004 |
| JP | 54-096416 | 7/1979 |
| JP | 58-031069 | 2/1983 |
| JP | 59-140355 | 8/1984 |
| JP | 60-221558 | 11/1985 |
| JP | 01-219121 | 9/1989 |
| JP | 02-270934 | 11/1990 |
| JP | 04-285119 | 10/1992 |
| JP | 11-036042 | 2/1999 |
| JP | 2000-513050 | 10/2000 |
| JP | 2005-226158 | 8/2005 |
| JP | 2006-089789 | 4/2006 |
| JP | 2006-124773 | 5/2006 |
| JP | 2007-253199 | 10/2007 |
| JP | 2011-052320 | 3/2011 |
| JP | 2011-202214 | 10/2011 |
| WO | WO 98/38345 | 9/1998 |
| WO | WO 2010/143726 | 12/2010 |

OTHER PUBLICATIONS

Office Action of Jun. 3, 2015 in corresponding Korean Application No. 10-2015-7003983.

International Search Report dated Mar. 11, 2014 issued in corresponding PCT Application No. PCT/JP2013/082501 [with English Translation].

Toshiei Hasegawa et al., "Influence of Ni and Mn on Toughness of Multi-Pass Weld Heat Affected Zone in Quenched and Tempered High Strength Steels", The Iron and Steel Institute of Japan, 1996, vol. 80 No. 6, pp. 51-56 [with English Translation].

European Search Report issued on Jan. 21, 2016 in corresponding European Application No. 13869587.9.

STEEL PLATE HAVING YIELD STRENGTH OF 670 TO 870 N/MM$^2$ AND TENSILE STRENGTH OF 780 TO 940 N/MM$^2$

TECHNICAL FIELD OF THE INVENTION

This application is a national stage application of International Application No. PCT/JP2013/082501, filed Dec. 3, 2013, which claims priority to Japanese Patent Application No. 2012-287666, filed on Dec. 28, 2012, each of which is incorporated by reference in its entirety.

The present invention relates to a steel plate which is a high tensile strength steel that has a yield strength of 670 to 870 N/mm$^2$ and a tensile strength of 780 to 940 N/mm$^2$ and is thus used for a welded structure of a storage tank container, construction equipment, offshore constructions, a large crane for ships, buildings, and the like, and in which the toughness of a base metal and the CTOD properties of a weld heat affected zone are excellent both before and after performing stress relief annealing (SR).

RELATED ART

In recent years, a welded structure of a storage tank container, construction equipment, offshore construction, a large crane for ships, and the like has been increasing in size, and the use of a high tensile strength steel capable of reducing the weight of the welded structure has been progressing. In order to secure the safety of a welded structure, recently, the fracture resistance of the welded structure is being evaluated using an evaluation method based on fracture mechanics and the evaluation is being applied to design. Specifically, in many cases, by a crack tip opening displacement test (CTOD test) specified in the standard WES 1108 by the Japan Welding Engineering Society as a property of initiating brittle fracture, a crack opening displacement amount (hereinafter, referred to as δc) called a CTOD value is obtained as a parameter based on fracture mechanics and whether or not the δc satisfies design criteria is evaluated.

In order to enhance the δc of a material, an improvement in properties of the material needs to be performed from a different viewpoint from that according to the related art. Hitherto, as an evaluation method of the brittle fracture resistance of a material, a charpy impact test has been in use. A value obtained by the charpy impact test represents an average toughness of an evaluation object region. However, in the CTOD test, even though the average toughness of the evaluation object region is good, when the evaluation object region includes any fragile region therein, the presence of the region is reflected in the δc. Since the δc has such properties, in order for a region such as a weld heat affected zone in which the microstructure of steel is non-uniform and changes with complexity to have a high δc value, a local embrittlement region needs to be reduced as much as possible.

Furthermore, in a large welded structure, in order to further reduce a possibility of fracture initiation, there may be cases where SR is performed on a weld. SR is a heat treatment method of heating a weld of a structure after welding to a temperature of equal to or less than an Ac1 transformation point and slowly cooling the resultant for the purpose of reducing residual stress caused by the welding. However, when SR relieving is applied to a high tensile strength steel having a tensile strength of 780 N/mm$^2$ or more, alloy carbides are selectively precipitated at grain boundaries and the alloy carbides causes intergranular embrittlement such that the toughness of an area in which SR is performed is extremely reduced. This phenomenon is generally called stress relief (SR) embrittlement. Particularly, in the high tensile strength steel which contains B and is produced by quenching and tempering, there is a strong tendency to generate SR embrittlement. In the high tensile strength steel, embrittlement of a base metal significant as well as embrittlement of a weld heat affected zone obtained when a welded joint is produced by using the high tensile strength steel is significant.

Therefore, in order for the welded structure to be produced by using the high tensile strength steel to obtain a high δ value and secure high safety, there is a need to develop a high tensile strength steel in which the toughness of a base metal or a heat affected zone is maintained at a high level even when SR is performed and a local embrittlement region is not generated in the weld heat affected zone.

From this point of view, hitherto, several techniques have been suggested. For example, in Patent Document 1, a high toughness quenched and tempered high tensile strength steel having low embrittlement sensitivity to SR, which is characterized in that the addition amounts of C, Mn, P, and Ni which may cause SR embrittlement are limited, is described. However, this invention is made for the purpose of improving the toughness of a base metal. Regarding the improvement in the toughness of a weld heat affected zone, which is intended by the present invention, no mention is made in Patent Document 1.

In Patent Document 2, a method of manufacturing a thick high tensile strength steel plate having high strength and high toughness and containing C: 0.02 to 0.20%, Si: 0.003 to 0.15%, P: 0.0005 to 0.010%, Mn, Ni, Cr, Mo, V, and B is disclosed. One of the features of the invention clarifies a finding that a reduction in the amount of Si is effective as means for securing toughness even in a chemical composition which has a low carbon equivalent and thus has low hardenability, thereby securing weldability. As a result, the charpy absorbed energies of a base metal and a weld heat affected zone described in Patent Document 2 reliably have high values. However, regarding the toughness after SR intended by the present invention, particularly for CTOD properties, no mention is made and the effect is totally unclear.

Patent Document 3 relates to a high toughness high tensile strength steel plate having extremely low tempering embrittlement and separation, which contains C: 0.03 to 0.30%, Si: 0.10 to 0.40%, Ni: 2.50 to 4.00%, Mn, Cr, Mo, V, and B and in which P: limited to 0.013% or less, Sb: limited to 0.007% or less, As: limited to 0.007% or less, and Sn: limited to 0.007% or less. One of the features of the invention is that the amounts of elements of impurities such as P, Sb, As, and Sn which are hitherto considered to be harmful to tempering embrittlement are reduced. However, the invention described in Patent Document 3 is made for the purpose of enhancing the toughness of a base metal, and the toughness of a weld heat affected zone intended by the present invention is not mentioned in Patent Document 3.

Patent Document 4 relates to a high tensile strength steel in the 80-kgf/mm$^2$ class having low sensitivity to SR cracking (SR cracking) and high toughness, which contains C: 0.08 to 0.18%, Si: 0.50% or less, Ni: 0.50 to 8.00%, Ca: 0.0005 to 0.0040%, Mn, Mo, V, and B and in which S: limited to 0.008% or less. The main feature of the invention is a reduction in the amount of S and the addition of Ca, and due to this feature, SR cracking in a weld is avoided. However, although the above-described feature is reliably effective in SR cracking in the weld, no mention is made in Patent Document 4 regarding whether or not the above-described feature is effective in SR embrittlement. Furthermore, description regarding the toughness of SR is not included in Patent Document 4.

Patent Document 5 discloses manufacturing of a quenched and tempered high tensile strength steel having good low temperature toughness and a thickness of 75 to 200 mm. Specifically, Patent Document 5 discloses a method of performing a heat treatment to a steel which contains C: 0.03 to 0.20%, Si: 0.05 to 0.50%, P: 0.010% or less, Ni: 1.0 to 10.0%, Mn, and B and selectively contains Cu, Cr, and Mo and in which a numerical value calculated from a specific expression regarding the amounts of C, Si, Mn, Cu, Ni, Cr, and Mo satisfies a predetermined range. In this invention, a steel having excellent base metal toughness can be reliably obtained. However, regarding the properties after SR intended by the present invention and the toughness after SR, no description is made in Patent Document 5.

In Patent Document 6, a high tensile strength steel which contains C: 0.18% or less, Si: 0.70% or less, P: 0.020% or less, Ni: 2.0% or less, and Mn and contains Cu, Cr, Mo, V, Nb, Ti, and B as necessary and in which a numerical value calculated from a specific expression regarding the amounts of C, Si, Mn, P, Cu, Ni, Cr, Mo, Nb, and Ti is 2.0 or less and SR embrittlement resistance of a weld heat affected zone is excellent is described. The object of the invention described in Patent Document 6 is to improve the toughness of the weld heat affected zone after SR like the object of the present invention. However, in Patent Document 6, a toughness evaluation method described in Examples is only a thermal cycle charpy test. Furthermore, in Patent Document 6, an object thereof is to cause a transition temperature in the thermal cycle charpy test to be −35° C. or less. The thermal cycle charpy test is a simple method to evaluate the toughness of a specific microstructure embrittled in the weld heat affected zone, but it is difficult to evaluate toughness caused by a complex microstructure such as the CTOD properties of a welded joint. It is difficult to say that manufacturing of steel capable of satisfying the CTOD properties of the weld heat affected zone, which is the object of the present invention, can be achieved by this invention.

In Patent Document 7, a method of manufacturing a thick high tensile strength steel having excellent low temperature toughness, which is characterized in that rolling and cooling are performed on a steel containing C: 0.03 to 0.15%, Si: 0.02 to 0.5%, Ni: 0.05 to 3.0%, Mn, Cr, Mo, V, and B in a heating and rolling process under specific manufacturing conditions is disclosed. This method is a reliably effective method in improving the base metal toughness of a thick material, particularly brittle crack propagation stop properties. However, regarding properties after SR and the toughness of a weld heat affected zone, no mention is made in Patent Document 7.

As described above, a high tensile strength steel having a tensile strength of 780 to 940 N/mm$^2$, in which the CTOD properties of a weld heat affected zone are good even after SR has still not been developed.

PRIOR ART DOCUMENT

Patent Document

[Patent Document 1] Japanese Unexamined Patent Application, First Publication No. S54-96416

[Patent Document 2] Japanese Unexamined Patent Application, First Publication No. S58-31069

[Patent Document 3] Japanese Unexamined Patent Application, First Publication No. S59-140355

[Patent Document 4] Japanese Unexamined Patent Application, First Publication No. S60-221558

[Patent Document 5] Japanese Unexamined Patent Application, First Publication No. H1-219121

[Patent Document 6] Japanese Unexamined Patent Application, First Publication No. H2-270934

[Patent Document 7] Japanese Unexamined Patent Application, First Publication No. H4-285119

Non-Patent Document

[Non-Patent Document 1] "Influence of Ni and Mn on Toughness of Multi-Pass Weld Heat Affected Zone in Quenched and Tempered High Strength Steels" by Toshiei HASEGAWA, etc, "Iron and Steel" Vol. 80 (1994) No. 6.

DISCLOSURE OF THE INVENTION

Problems to be Solved by the Invention

The present invention relates to providing a high tensile strength steel having a yield strength of 670 to 870 N/mm$^2$ and a tensile strength of 780 to 940 N/mm$^2$ and having excellent CTOD properties after SR, which is hitherto manufactured with difficulty. Particularly, an object of the present invention is to provide a steel plate capable of enhancing the safety of a structure without generating a local embrittlement region in a weld heat affected zone and reducing the toughness of an area in which SR is performed, for a large welded structure of a storage tank container, construction equipment, offshore construction, a large crane for ships, buildings, and the like, which generally requires SR and is made of a high tensile strength steel plate.

In the present invention, "base metal" and "weld heat affected zone" respectively mean a base metal and a weld heat affected zone (in some cases, referred to as a heat affected zone or HAZ) of a welded joint produced by welding the steel plate of the present invention. The base metal before SR is considered to be the same as the steel plate of the present invention.

Means for Solving the Problem (Relationship Between Average Grain Size of Base Metal and SR Embrittlement of Base Metal)

First, the inventors examined SR embrittlement (hereinafter, may be referred to as "embrittlement") of a base metal before improving the toughness of a weld heat affected zone. The inventors thought that SR embrittlement of the base metal has a tendency to become significant as grain sizes increase. Here, first, regarding a high tensile strength steel having a tensile strength in the 780-MPa class, the relationship between $\Delta vTrs_{BM}$ ('charpy transition temperature of the base metal before SR'−'charpy transition temperature of the base metal after SR') which indicates an SR embrittlement degree of the base metal and an average grain size was examined.

The charpy transition temperature (transition temperature) is an index which indicates brittle fracture resistance of a material and corresponds to a fracture appearance transition temperature (a temperature at which a ductile fracture appearance ratio is 50%) obtained by "Method for Charpy pendulum impact test of metallic materials" defined in JIS Z 2242 (2005). In a case where the transition temperature of a material is low, it is determined that the material has excellent brittle fracture resistance. By obtaining the $\Delta vTrs_{BM}$ which is a value obtained by subtracting the transition temperature of a material after SR from the transition temperature of the material before SR, the effect of SR on the brittle fracture resistance of the material can be evaluated. In a case where the $\Delta vTrs_{BM}$ is 0° C. or less, it is determined that the transition temperature is not increased by SR and SR embrittlement of the base metal does not occur.

An average grain size is defined as follows. A grain is defined as an area surrounded by a boundary in which a misorientation is 30° or more and which is identified by performing an orientation analysis using an electron beam backscatter diffraction pattern analysis method, a grain size is defined as an equivalent circle diameter of the grain, and an average grain size is defined as a grain size at which a cumulative frequency is 90% when a frequency distribution of the grain size is calculated from a small grain size side.

The examination of the relationship between the $\Delta vTrs_{BM}$ and the average grain size was performed by a method described as follows. A slab having a chemical composition which includes C: 0.10%, Si: 0.03%, Mn: 0.93%, P: 0.0030%, S: 0.0022%, Cu: 0.25%, Ni: 1.21%, Cr: 0.45%, Mo: 0.32%, V: 0.023%, Al: 0.067%, N: 0.53%, B: 0.0009%, and remainder including Fe and an impurity was heated to 1200° C. and was then hot-rolled into a steel plate having a plate thickness of 75 mm. A quenching treatment of heating the steel plate to 900 to 1000° C. and then water-cooling the steel plate and a tempering treatment of heating the steel plate to 620° C. and then water-cooling the steel plate were performed. An impact test specimen and a microstructure sample of the base metal were machined from mid-thickness (½t) of the steel plate which was subjected to the quenching treatment and the tempering treatment, to obtain a sample for the examination of the relationship between the $\Delta vTrs_{BM}$ and the average grain size. The reason why the sample is machined from ½t is that an area in which the toughness is most degraded is ½t in a case where SR embrittlement occurs. A charpy impact test and an EBSD analysis were performed on the sample to obtain the transition temperature (corresponding to the charpy transition temperature of the base metal before SR embrittlement) of the sample and the average grain size.

Furthermore, SR was performed on the steel plate which was subjected to the quenching treatment and the tempering treatment, at 560° C. for 3 hours (here, a rate of temperature increase and a rate of temperature decrease within a temperature range of 425° C. or more is 55° C./hour or less). An impact test specimen was machined from ½t of the steel plate after SR, and the transition temperature (corresponding to the charpy transition temperature of the base metal after SR embrittlement) of the sample was obtained by the charpy impact test.

The difference between the transition temperature of the sample before SR and the transition temperature of the sample after SR was calculated, and the difference was used as the $\Delta vTrs_{BM}$. The relationship between the $\Delta vTrs_{BM}$ and the average grain size is illustrated in FIG. 1.

In FIG. 1, a case in which the $\Delta vTrs_{BM}$ in the vertical axis is 0° C. or less is a preferable state in which SR embrittlement of the base metal does not occur. In FIG. 1, it was seen that in a case where the average grain size of the base metal was more than 35 μm, SR embrittlement had occurred in the base metal. That is, the inventors found that causing the average grain size of the base metal to be 35 μm or less was effective in substantially eliminating SR embrittlement from the base metal in the high tensile strength steel having a tensile strength in the 780-MPa class.

(Relationship Between α Value, β Value, and CTOD Properties)

In addition, the inventors performed a CTOD test to a welded joint after SR of a high strength steel which is an object of the present invention for the purpose of improving the toughness of a weld heat affected zone. The CTOD test is one of the tests to evaluate fracture toughness of a structure having defects. In the CTOD test, unstable fracture (a phenomenon in which cracks rapidly propagate) is caused by applying bending stress to a test specimen with cracks while a predetermined temperature is maintained, and a crack tip opening amount immediately before the occurrence of the unstable fracture is measured, thereby obtaining a CTOD value. In a case where the CTOD value of a material is high, it is determined that the material has high toughness.

One of the objects of the present invention is to obtain a steel plate which enables a welded joint having a toughness corresponding to a $\delta c_{-10}$ value, which is a CTOD value at −10° C., of 0.15 mm or more to be produced in a case where general welding in the technical field of the present invention is performed. The target value is employed by Lloyd's Register and the like.

The inventors minutely observed an initiation origin of brittle cracks in the CTOD test specimen which is fractured from the weld heat affected zone. As a result, it was confirmed that the brittle cracks were initiated from a region (coarse-grained region) where the structure is coarsened by the effect of weld heat.

The inventors thought based on the above-described observation results that improving toughness after SR is effective even in the weld heat affected zone, particularly in the coarse-grained region in order to obtain a high tensile strength steel having excellent CTOD properties after SR and the welded joint thereof. Here, many experiments were conducted for improving the toughness in the coarse-grained region after SR as a main object. As a result, it is found that in order to control CTOD properties, an α value which is calculated from the amounts of C, Si, and P and a β value which is calculated from the amounts of C, Si, Mn, Cu, Ni, Cr, and Mo need to be controlled. Hereinafter, the reason will be described.

First, in order to clarify the relationship between results of a charpy impact test of a sample after a synthetic thermal cycle and the CTOD properties of a welded joint, the inventors conducted a test described as follows. In the welded joint, the correspondence relationship between the CTOD properties and a charpy absorbed energy and/or transition temperature of the weld heat affected zone is well known in the standard WES 2805 of the Japan Welding Engineering Society, and the like. However, the correlation between the charpy test result of the sample after the synthetic thermal cycle and the CTOD properties of the welded joint, which is necessary for the present invention, is not well known.

The test was conducted in the following order. First, various steels having various chemical compositions in a range of C: 0.07 to 0.13%; Si: 0.02 to 0.35%; Mn: 0.55 to 1.44%; P: 0.001 to 0.0090%; S: 0.0005 or 0.003%; Cu: 0.15 to 0.53%; Ni: 0.59 to 4.82%; Cr: 0.48 to 1.35%; Mo: 0.25 to 0.95%; V: 0.02 to 0.05%; Al: 0.020 to 0.087%; N: 0.0021 to 0.0074%; and B: 0.0007 to 0.0012% were hot-rolled into steel plates having a plate thickness of 25 mm. In addition, a quenching treatment (900 to 920° C.) and a tempering treatment (610 to 650° C.) were performed on the steel plates to obtain steel plates in which the yield strengths of the steel plates were adjusted to be 675 to 805 $N/mm^2$ and the tensile strengths thereof were adjusted to be 795 to 899

$N/mm^2$. Subsequently, the steel plates were welded with a heat input of 2.5 kJ/mm to produce arc welded joints, and SR (held at 560° C. for 6 hours, here, with a rate of temperature increase within a temperature range of 425° C. or more and a rate of temperature decrease within the temperature range of 425° C. or more are 55° C./hour or less) was performed on the arc welded joints. The CTOD test was performed on the arc welded joints in which SR was performed on obtain the δc ($\delta c_{-10}$) of the arc welded joints at a test temperature of −10° C. Simultaneously with this, a synthetic thermal cycle test that applies a weld heat cycle in which an average cooling rate is 20° C./s between 800° C. and 500° C. at a maximum heating temperature of 1350° C. (held for 1 s) was performed on the above-described steel plates (that were not subjected to welding). By applying the heat cycle, test specimens having simulated weld heat affected zones of steel were obtained. In addition, SR was performed on the test specimens under the same conditions as those of the above-described SR. The charpy impact test was conducted to the test specimens to obtain transition temperatures $vTrs_{SR}$ after SR.

A graph which is obtained to illustrate the correlation between CTOD properties $\delta c_{-10}$ of actual welded joints after SR and the transition temperatures $vTrs_{SR}$ of the test specimens after SR, which were subjected to the synthetic thermal cycle, is illustrated in FIG. 2. The inventors found from the graph plotted by the above-described method that there is a good linear relationship between the $\delta c_{-10}$ and the $vTrs_{SR}$.

From the graph illustrated in FIG. 2, it was seen that the $\delta c_{-10}$ by which the $vTrs_{SR}$ was set to +40° C. was 0.15 mm. Therefore, causing the vTrs ($vTrs_{SR}$) to be +40° C. or less after SR embrittlement of the sample in which the synthetic thermal cycle test and SR were performed under the above-described conditions, was necessary to sufficiently enhance the CTOD properties of the joint, and this was determined as the $vTrs_{SR}$ which is the target of the present invention.

The inventors thought that in order to achieve the target value of the transition temperature after SR which was obtained by the above-described experiments, (1) an SR embrittlement degree ΔvTrs of the weld heat affected zone and (2) the transition temperature $vTrs_{AW}$ of the weld heat affected zone before SR need to be controlled. Here, the SR embrittlement degree ΔvTrs of the weld heat affected zone is the difference between the transition temperature $vTrs_{AW}$ of the heat affected zone before SR and the transition temperature $vTrs_{SR}$ of the heat affected zone after SR, and can be calculated by the following expression 1.

$$\Delta vTrs = vTrs_{SR} - vTrs_{AW} \quad \text{(expression 1)}$$

That is, the SR embrittlement degree ΔvTrs of the weld heat affected zone is an index for evaluating a degree of embrittlement that occurs in the weld heat affected zone when SR is performed on the welded joint. In a case where the ΔvTrs is more than 0° C., the transition temperature after SR is increased, that is, toughness is reduced. Accordingly, it is determined that SR embrittlement occurs.

In addition, the inventors also refer to the transition temperature of a sample obtained by a synthetic thermal cycle test, which will be described later, as $vTrs_{AW}$, and also refer the transition temperature of the sample in which SR is performed after the synthetic thermal cycle test as $vTrs_{SR}$. Therefore, ΔvTrs is also the difference between the transition temperatures of a sample subjected to the synthetic thermal cycle test before and after SR.

First, in order to examine factors which affect the SR embrittlement degree ΔvTrs of the weld heat affected zone, the inventors produced a steel having a chemical composition within the chemical composition range of the steel plate in the HT780-$N/mm^2$ class (having a tensile strength of 780 $N/mm^2$ or more) which is the target of the present invention, and conducted the synthetic thermal cycle test simulating the weld heat affected zone to the steel. The specific order is described as follows.

First, various steels having various chemical compositions in a range of C: 0.07 to 0.13%; Si: 0.02 to 0.35%; Mn: 0.55 to 1.44%; P: 0.001 to 0.0090%; S: 0.0005 or 0.003%; Cu: 0.15 to 0.53%; Ni: 0.59 to 4.82%; Cr: 0.48 to 1.35%; Mo: 0.25 to 0.95%; V: 0.02 to 0.05%; Al: 0.020 to 0.087%; N: 0.0021 to 0.0074%; and B: 0.0007 to 0.0012% were hot-rolled into steel plates having a plate thickness of 25 mm. In addition, a quenching treatment (900 to 920° C.) and a tempering treatment (610 to 650° C.) were performed on the steel plates to adjust the yield strengths of the steel plates to be 675 to 805 $N/mm^2$ and to adjust the tensile strengths thereof to be 795 to 899 $N/mm^2$. Thereafter, synthetic thermal cycle test specimens were machined from the surroundings of plate thickness ¼t of the steel plates, and a synthetic thermal cycle (a cycle corresponding to a weld heat cycle) having an average cooling rate of 20° C./s between 800° C. and 500° C. at a maximum heating temperature of 1350° C. (held for 1 s) was applied to the test specimens. In addition, the transition temperature ($vTrs_{AW}$) of the sample (As Weld (AW)) just as subjected to the heat cycle and the transition temperature ($vTrs_{SR}$) of the sample to which SR (held at 560° C. for 6 hours and then cooled to 150° C. or less at 55° C./hour) was performed were obtained by the charpy impact test, and a SR embrittlement degree of the weld heat affected zone was obtained from the difference between the two (see expression 1).

The inventors analyzed the relationship between the ΔvTrs and $vTrs_{AW}$ which were obtained by the above-described method and the chemical composition. As a result, it was found that there was a correlation between the ΔvTrs and the α value expressed by the following expression 2.

$$\alpha = \text{'C'} + 6 \times \text{'Si'} + 100 \times \text{'P'} \quad \text{(expression 2)}$$

'C', 'Si', and 'P' are respectively the amounts (mass %) of C, Si, and P in the steel.

In FIG. 3, a graph in which the measurement results are plotted so that the vertical axis represents the SR embrittlement degree (ΔvTrs) of the weld heat affected zone and the horizontal axis represents the α value is illustrated as the analytical results. From the graph, the inventors found that the SR embrittlement degree (ΔvTrs) of the weld heat affected zone in the steel within the above-described chemical composition range is strongly affected by the α value caused by the limited components (C, Si, and P) among the many alloy elements.

Hitherto, it has been thought in any of a base metal and a weld, embrittlement during SR is caused by an intergranular embrittlement phenomenon called tempering embrittlement, which occurs during holding at a temperature of 500° C. or less and precipitation embrittlement of a carbide forming element, which occurs during holding for a long period of time at a temperature of 550° C. or higher. Therefore, as a method of improving toughness after SR, a reduction in the amounts of Si, P, Mn, Ni, and the like which are components that are likely to facilitate tempering embrittlement, a reduction in the amounts of Mo, Cr, V, and the like which are components that generates carbides, and the like have been suggested in the related art. However, a part of these elements are elements which are necessary for increasing the tensile strength of the steel plate. Therefore, there were cases where in order to secure the tensile strength of the steel plate, the above-described methods could not be employed.

Contrary to this, findings obtained from the graph of FIG. 3 plotted by the inventors show that the SR embrittlement degree of the steel can be determined by using an α value calculated from the amounts of Si and P which are embrittlement elements and the amount of C. According to the findings, a degree of freedom in alloy design can be enhanced.

Here, in the present invention, the upper limit of the α value was set to 1.0 mass % for the following reasons. In order to reduce the α value, the amounts of C, Si, and P have to be reduced. However, in a case of considering limitations caused by tensile strength of steel and performance of a manufacturing facility, it is preferable that the α value be as high as possible. Particularly, the steel plate according to the present invention is a steel plate having a tensile strength of 780 N/mm$^2$ or more, and thus the lower limit of the amount of C experimentally needs to be about 0.07%. In order to secure the amount of C and to perform the removal of P and Si at a practical level for industrial applications, the α value needs to be 1.0 mass % or less.

In a case where the α value of the steel plate is 1.0 mass % or less, it can be seen from FIG. 3 that the ΔvTrs of the heat affected zone is about 100° C. or less. It could be seen that the $vTrs_{AW}$ needs to be −60° C. or less in order for the $vTrs_{SR}$ to be reliably 40° C. or less with the ΔvTrs obtained by calculating $vTrs_{SR}-vTrs_{AW}$ being 100° C. or less.

The inventors further analyzed the relationship between the ΔvTrs and $vTrs_{AW}$ which are obtained by the above-described method and the chemical composition. As a result, it was determined that there is a correlation between the $vTrs_{AW}$ and the β value expressed by the following expression 3.

$$\beta=0.65\times\text{'C'}^{1/2}\times(1+0.64\times\text{'Si'})\times(1+4.10\times\text{'Mn'})\times(1+0.27\times\text{'Cu'})\times(1+0.52\times\text{'Ni'})\times(1+2.33\times\text{'Cr'})\times(1+3.14\times\text{'Mo'}) \quad \text{(expression 3)}$$

'C', 'Si', 'Mn', 'Cu', 'Ni', 'Cr', and 'Mo' indicate the amounts (mass %) of C, Si, Mn, Cu, Ni, Cr, and Mo in steel.

In FIG. 4, a graph in which the examination results are plotted so that the vertical axis represents the transition temperature ($vTrs_{AW}$) just as subjected to the heat cycle of the coarse-grained region of the weld heat affected zone and the horizontal axis represents the β value is illustrated. The β value is an index which indicates hardenability of a steel containing alloy elements described in Non-Patent Document 1. As the β value increases, a larger amount of the alloy elements which contribute to the hardenability of the steel are contained, resulting in high hardenability. Referring to FIG. 4, the graph which shows the relationship between the toughness of the coarse-grained region subjected to the weld heat cycle and the β value has a V-shaped tendency. A β value which causes the lowest $vTrs_{AW}$, that is, has a proper value regarding the $vTrs_{AW}$ is about 12. It was seen from the graph illustrated in FIG. 4 that, in both a case where the β value is more than 12 and a case where the β value is less than 12, the toughness of the coarse-grained region subjected to the weld heat cycle is reduced. That is, it was seen that regarding an enhancement in the toughness of the coarse-grained region of the weld heat cycle, an optimal range that the β value is present is centered on about 12.

As described above, in the present invention, the $vTrs_{AW}$ needs to be −60° C. or less. It was seen from the graph illustrated in FIG. 4 that the β value needs to be in a range of 8.45 to 15.2 in order to achieve the above-described $vTrs_{AW}$. From the above description, in the present invention, the range of the β value was specified to 8.45 to 15.2 in order to cause the $vTrs_{AW}$ represented by the vertical axis of FIG. 4 to be −60° C.

As described above, an object of the present invention is to provide a reasonable guideline on alloy design for allowing a weld heat affected zone of a high tensile strength steel in which the yield strength is 670 N/mm$^2$ or more and the tensile strength is 780 N/mm$^2$ or more after quenching and tempering and SR is performed, to have excellent CTOD properties, and a steel plate which can be manufactured using the guideline and thus has high safety. The summary thereof is as follows.

(1) A steel plate according to an aspect of the present invention has a chemical composition including, in terms of mass %: C: 0.07 to 0.10%; Si: 0.01 to 0.10%; Mn: 0.5 to 1.5%; Ni: 0.5 to 3.5%; Cr: 0.1 to 1.5%; Mo: 0.1 to 1.0%; V: 0.005 to 0.070%; Al: 0.01 to 0.10%; B: 0.0005 to 0.0020%; N: 0.002 to 0.010%; P: 0.006% or less; S: 0.003% or less; Cu: 0 to 1%; Nb: 0 to 0.05%; Ti: 0 to 0.020%; Ca: 0 to 0.0030%; Mg: 0 to 0.0030%; REM: 0 to 0.0030%; and remainder including Fe and an impurity, in which an α value defined by expression A is 0.13 to 1.0 mass % and a β value defined by expression B is 8.45 to 15.2, an yield strength is 670 to 870 N/mm$^2$, and a tensile strength is 780 to 940 N/mm$^2$, a grain is defined as an area surrounded by a boundary in which a misorientation which is identified by performing an orientation analysis using an electron beam backscatter diffraction pattern analysis method is 30° or more, a grain size is defined as an equivalent circle diameter of the grain, an average grain size is defined as the grain size in which a cumulative frequency is 90% when a frequency distribution of the grain size is cumulated from a small grain size side, and the average grain size at mid-thickness of the steel plate is 35 μm or less, a plate thickness is 25 to 200 mm, $$\alpha=\text{'C'}+6\times\text{'Si'}+100\times\text{'P'} \quad \text{expression A}$$

$$\beta=0.65\times\text{'C'}^{1/2}\times(1+0.64\times\text{'Si'})\times(1+4.10\times\text{'Mn'})\times(1+0.27\times\text{'Cu'})\times(1+0.52\times\text{'Ni'})\times(1+2.33\times\text{'Cr'})\times(1+3.14\times\text{'Mo'}) \quad \text{expression B,}$$

and

'C', 'Si', 'P', 'Mn', 'Cu', 'Ni', 'Cr', and 'Mo' indicate amounts of C, Si, P, Mn, Cu, Ni, Cr, and Mo in terms of mass %, respectively.

(2) In the steel plate described in (1), the chemical composition may include, in terms of mass %: Mn: 0.7 to 1.2%; Ni: 0.8 to 2.5%; Cr: 0.5 to 1.0%; Mo: 0.35 to 0.75%; V: 0.02 to 0.05%; Al: 0.04 to 0.08%; and Cu: 0.2 to 0.7%.

(3) In the steel plate described in (1) or (2), the plate thickness of the steel plate may be 50 to 150 mm.

(4) In the steel plate described in any one of (1) to (3), when a stress relief annealing is performed on the steel plate with a holding temperature being 560° C., a holding time being h hour defined by expression C and expression D, and a rate of temperature increase within a temperature range of 425° C. or more and a rate of temperature decrease within the temperature range of 425° C. or more being 55° C./hour or less, a charpy absorbed energy at −40° C. in an area in which the stress relief annealing is performed may be 100 J or more, $$\text{when } t\geq 50,\ h=t/25 \quad \text{expression C,}$$

$$\text{when } t<50,\ h=2 \quad \text{expression D, and}$$

t indicates the plate thickness of the steel plate in terms of mm and h indicates the holding time in unit of hour.

Effects of the Invention

A high tensile strength steel plate having the chemical composition and the α value which are specified in the present invention, and thus has an yield strength of 670 to 870 N/mm$^2$ and a tensile strength of 780 to 940 N/mm$^2$ and allows an SR embrittlement degree ΔvTrs of a weld heat affected zone to be 100° C. or less even when a stress relief annealing (SR) is performed during welding, can be obtained. Furthermore, as the high tensile strength steel plate has the β value specified in the present invention, a transition temperature thereof as welded (before SR) can be allowed to be −60° C. or less. As the high tensile strength steel plate satisfies both the α value and the β value, a steel plate which can be used to produce a welded joint with a transition temperature of 40° C. or less after SR can be obtained, and the welded joint corresponds to a welded joint in which a CTOD value $\delta c_{-10}$ at −10° C. is 1.5 mm or more. Therefore, according to the present invention, it is possible to provide a high tensile strength steel plate that can obtain high CTOD properties even after the welding and SR.

EMBODIMENT OF THE INVENTION

Figure 1:
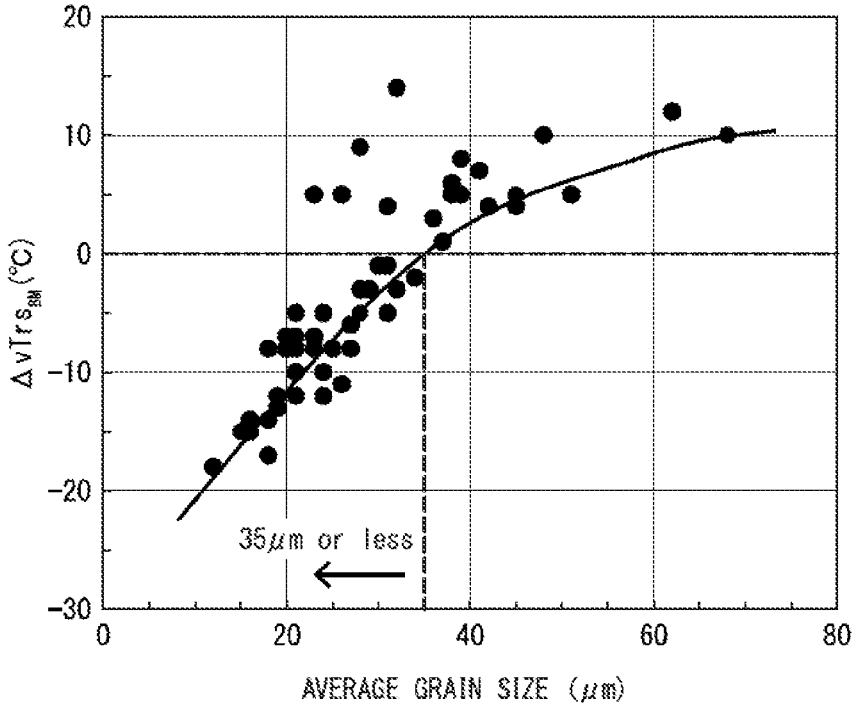
FIG. 1 is a graph showing the relationship between the average grain size of a base metal and an SR embrittlement degree ($\Delta vTrs_{BM}$) of the base metal.

Hereinafter, an embodiment will be described in detail.

A "SR" in this embodiment means, if not particularly defined, SR based on the contents specified in JIS Z 3700-2009 "Methods of post weld heat treatment". In this embodiment, "welding" means, if not particularly defined, welding with a weld heat input of 1.1 to 4.5 kJ/mm. The conditions are general conditions in the technical field of the present invention. However, even when SR or the welding is performed under different conditions from the above-described conditions, the same effects as those of SR or the welding which is performed under the above-described condition can be obtained. Therefore, SR or the welding may be performed on a steel plate according to this embodiment under different conditions from the above-described condition.

First, the reason that steel components in this embodiment are limited will be described. Hereinafter, if not particularly defined, "%" means mass %.

(C: 0.07 to 0.10%)

C is an element which improves the strength of a base metal. In order to achieve the strength which is the object of the steel plate according to this embodiment, C needs to be contained at a content of 0.07% or more and preferably 0.08% or more. In a case where a large amount of C is contained, the hardness of a weld heat affected zone is increased and the toughness thereof is simultaneously reduced, and thus the upper limit of the amount of C is 0.10% and preferably 0.09%.

(Si: 0.01 to 0.10%)

In many cases, Si is generally contained in a steel as a deoxidizing element. However, in this embodiment, Si reduces the toughness of the steel after SR, and thus the upper limit of the amount of Si is 0.10% and preferably 0.09%, 0.08%, or 0.07%. Since Si is contained for the purpose of deoxidation, the lower limit of the amount of Si is 0.01%.

(Mn: 0.5 to 1.5%)

Mn is an element effective in deoxidation, and improves the strength of the steel. Therefore, the lower limit of the amount of Mn is 0.5% and preferably 0.7%. If necessary, the lower limit of the amount of Mn may be 0.6%, 0.75%, 0.8%, or 0.85%. However, when Mn is excessively contained, there is concern that the toughness of the steel after SR may be reduced by tempering embrittlement. Accordingly, the upper limit of the amount of Mn is 1.5% and preferably 1.2%. If necessary, the upper limit of the amount of Mn may be 1.4%, 1.3%, 1.25%, or 1.15%.

(Ni: 0.5 to 3.5%)

Ni is an element effective in improving the hardenability and toughness of the steel, and thus the lower limit of the amount of Ni is 0.5% and preferably 0.8%. If necessary, the lower limit of the amount of Ni may be 0.7%, 0.9%, 1.0%, 1.2%, or 1.4%. However, when Ni is excessively contained, there is concern that the toughness of the steel after SR may be reduced. Accordingly, the upper limit of the amount of Ni is 3.5% and preferably 2.5%. If necessary, the upper limit of the amount of Ni may be 3.0%, 2.8%, 2.3%, or 2.1%.

(Cr: 0.1 to 1.5%)

Cr is an element effective in improving the hardenability of the steel and improving the strength of the steel by precipitation strengthening during tempering. Therefore, the lower limit of the amount of Cr is 0.1% and preferably 0.5%. If necessary, the lower limit of the amount of Cr may be 0.2%, 0.3%, 0.4%, or 0.6%. However, when Cr is excessively contained, there is concern that toughness of the base metal and the weld heat affected zone after SR may be reduced. Accordingly, the upper limit of the amount of Cr is 1.5% and preferably 1.0%. If necessary, the upper limit of the amount of Cr may be 1.3%, 1.2%, 1.1%, or 0.9%.

(Mo: 0.1 to 1.0%)

Like Cr, Mo is an element effective in improving the hardenability and improving the strength of the steel by precipitation strengthening during tempering. Therefore, the lower limit of the amount of Mo is 0.1% and preferably 0.35%. If necessary, the lower limit of the amount of Mo may be 0.2%, 0.3%, or 0.4%. However, when Mo is excessively contained, there is concern that Mo carbides may precipitate at the boundaries and thus the toughness of the base metal and the weld heat affected zone after SR may be reduced. Particularly, the weld heat affected zone is significantly affected. Accordingly, the upper limit of the amount of Mo is 1.0% and preferably 0.75%. If necessary, the upper limit of the amount of Mo may be 0.9%, 0.8%, 0.7%, or 0.6%.

(V: 0.005 to 0.070%)

Like Cr and Mo, V is an element effective in improving the hardenability and improving the strength of the steel by precipitation strengthening during tempering. Therefore, the amount of V is 0.005% or more and preferably 0.02% or more. If necessary, the lower limit of the amount of V may be 0.01%, 0.025%, or 0.03%. However, when V is excessively contained, there is concern that the toughness of the base metal and the toughness pf the weld heat affected zone after SR may be reduced. Accordingly, the upper limit of the amount of V is 0.07% and preferably 0.05%. If necessary, the upper limit of the amount of V may be 0.06% or 0.045%.

(Al: 0.01 to 0.10%)

Al is a useful element for deoxidation, and is an element which forms nitrides and thus causes a reduction in grain size during quenching. In this embodiment, Al needs to be contained at a content of 0.01% or more and preferably 0.04% or more. If necessary, the lower limit of the amount of Al may be 0.02%, 0.03%, or 0.05%. However, when Al is excessively contained, there is concern that Al may form coarse nitrides and thus the toughness of the base metal and the weld heat affected zone may be reduced. Accordingly, the upper limit of the amount of Al is 0.1% and preferably 0.08%. If necessary, the upper limit of the amount of Al may be 0.09% or 0.07%.

(B: 0.0005 to 0.0020%)

B is an element which improves the hardenability of the steel when a small amount of B is contained in this embodiment. Therefore, the lower limit of the amount of B is 0.0005%. If necessary, the lower limit of the amount of B may be 0.0007%, 0.0009%, or 0.001%. However, when B is excessively contained, there may be cases where B forms coarse nitrides and/or coarse carbides and the toughness of the base metal and the weld heat affected zone is reduced. Accordingly, the upper limit of the amount of B is 0.0020%. If necessary, the upper limit of the amount of B may be 0.0018% or 0.0016%.

(N: 0.002 to 0.010%)

N is an element which forms nitrides and thus causes a reduction in the grain size of the base metal, thereby enhancing toughness. Therefore, the lower limit of the amount of N is 0.002%. If necessary, the lower limit of the amount of N may be 0.0025%, 0.003%, or 0.0035%. However, when N is excessively contained, nitrides become coarsened, and thus the toughness of the weld heat affected zone as welded is reduced. Accordingly, the upper limit of the amount of N is 0.010%. If necessary, the upper limit of the amount of N may be 0.008%, 0.007%, or 0.006%.

(P: 0.006% or Less)

(S: 0.003% or Less)

P and S are impurity elements which are contained in the steel, and the amounts thereof are preferably as low as possible. Therefore, the lower limits of the amount of P and the amount of S are 0%. In this embodiment, in order to enhance the toughness of a weld after SR, the upper limit of the amount of P is 0.006% and preferably 0.003%. If necessary, the upper limit of the amount of P may be 0.005%, 0.004%, or 0.002%. Furthermore, the upper limit of the amount of S is 0.003%. If necessary, the upper limit of the amount of S may be 0.002% or 0.0015%.

(Cu: 0 to 1%)

Cu is not an essential element in this embodiment, and thus the lower limit of the amount of Cu is 0%. However, Cu has an effect of improving the strength of the steel, and thus may be contained if necessary. In a case where Cu is contained, in order to use the effect, the amount of Cu may be 0.1% or more and preferably 0.2% or more. If necessary, the lower limit of the amount of Cu may be 0.15% or 0.3%. However, when Cu is excessively contained, there is concern that toughness of the base metal may be reduced by crack initiation on the surface of a steel plate and precipitation of Cu. Accordingly, the upper limit of the amount of Cu is 1% and preferably 0.7%. If necessary, the upper limit of the amount of Cu may be 0.8%, 0.6%, 0.5%, or 0.4%.

(Nb: 0 to 0.05%)

Nb is not an essential element in this embodiment, and thus the lower limit of the amount of Nb is 0%. However, Nb is an element which refines grains during quenching, and thus may be contained if necessary. In a case where Nb is contained, in order to use the effect, Nb may be contained at a content of 0.005% or more, or 0.01% or more. However, when Nb is excessively contained, there is concern that Nb may form coarse carbonitrides and thus the toughness of the base metal may be reduced. Accordingly, the upper limit of the amount of Nb is 0.05%. The toughness of the weld heat affected zone is enhanced as Nb is reduced, and thus the upper limit of the amount of Nb may be 0.03%, 0.02%, 0.01%, 0.005%, or 0.002%.

(Ti: 0 to 0.020%)

Ti is not an essential element in this embodiment, and thus the lower limit of the amount of Ti is 0%. However, Ti may refine grains when the steel is heated to a high temperature by slab heating and the like, and thus may be contained if necessary. In a case where Ti is contained, in order to use the effect, the amount of Ti may be 0.005% or more. Here, when Ti is excessively contained, like Nb, there is concern that Ti may form coarse carbonitrides and thus the toughness of the base metal may be reduced. Accordingly, the upper limit of the amount of Ti is 0.020%. If necessary, the upper limit of the amount of Ti may be 0.015%, 0.010%, 0.005%, or 0.002%.

(Ca: 0 to 0.0030%)

(Mg: 0 to 0.0030%)

(REM: 0 to 0.0030%)

Furthermore, in this embodiment, one or more of Ca, Mg, and REM may be contained.

Ca causes spherodization of sulfides in the steel plate, and thus has an effect of reducing an influence of MnS which reduces the toughness of the steel plate. In order to obtain the effect, the lower limit of the amount of Ca may be 0.0001%. However, when a large amount of Ca is contained, there is concern that weldability of the steel may be damaged, and thus the upper limit of the amount of Ca is 0.0030%. If necessary, the upper limit of the amount of Ca may be 0.0015%, 0.0010%, 0.0005%, or 0.0002%.

Mg and REM form oxides, and thus enhance the toughness of the weld heat affected zone. In order to obtain the effect, each of the amount of Mg and the amount of REM may be 0.0001% or more. However, when a large amount of Mg and a large amount of REM are contained, there is concern that coarse oxides may be formed and thus the toughness of the steel may be reduced. Accordingly, the upper limits of the amount of Mg and the amount of REM are 0.0030%. If necessary, the upper limits of the amount of Mg and the amount of REM may be 0.015%, 0.010%, 0.005%, or 0.002%.

Ca, Mg, and REM are not essential elements, and thus all of the lower limits of the amount of Ca, the amount of Mg, and the amount of REM are 0%.

(Remainder Including Fe and Impurity)

A steel according to this embodiment includes a remainder including Fe and an impurity, in addition to the above-described components. Here, the impurity is a component which is incorporated by raw materials such as mineral or scrap or various factors of a manufacturing process when the steel is industrially manufactured, and is accepted within a range that does not adversely affect the present invention.

In addition, the steel plate according to this embodiment may further contain Sb, As, Sn, Pb, Zr, Zn, W, and Co for the purpose of improving the properties of the steel itself or as an impurity from an auxiliary raw material such as scrap, in addition to the above-described components. However, including such elements is not essential, and thus the lower limits of the amounts of the elements are 0%. In addition, the upper limits of the amounts of the elements are preferably as follows.

Sb damages the toughness of the HAZ, and thus the upper limit of the amount of Sb may be 0.02%. In order to further enhance the toughness of the HAZ, the upper limit of the amount of Sb may be 0.01%, 0.005%, or 0.002%.

As, Sn, and Pb damage the toughness of the HAZ. Therefore, the upper limits of the amount of As and the amount of Sn may be 0.02%. If necessary, the upper limits of the amount of As and the amount of Sn may be 0.01%, 0.005%, or 0.002%. The upper limit of the amount of Pb may be 0.1% or less, 0.01%, or 0.005% or less.

Like Ti, Zr is an element which forms nitrides and thus enhances the toughness of the HAZ. However, on the contrary, the addition of a large amount of Zr causes a reduction in the toughness of the HAZ, and thus the upper limit of the amount of Zr may be 0.1%, 0.01%, or 0.005%.

Zn and W improve the strength of the steel by being contained in the steel. However, the addition of a large amount of Zn or W causes a reduction in the toughness of the base metal and the HAZ, and thus the upper limits of the amount of Zn and the amount of W may be 0.1%, 0.01%, or 0.005%.

There may be cases where Co is contained in Ni of a raw material as an impurity. Co damages the toughness of the HAZ, and thus the upper limit of the amount of Co may be 0.2%, 0.1%, or 0.05%.

Figure 3:
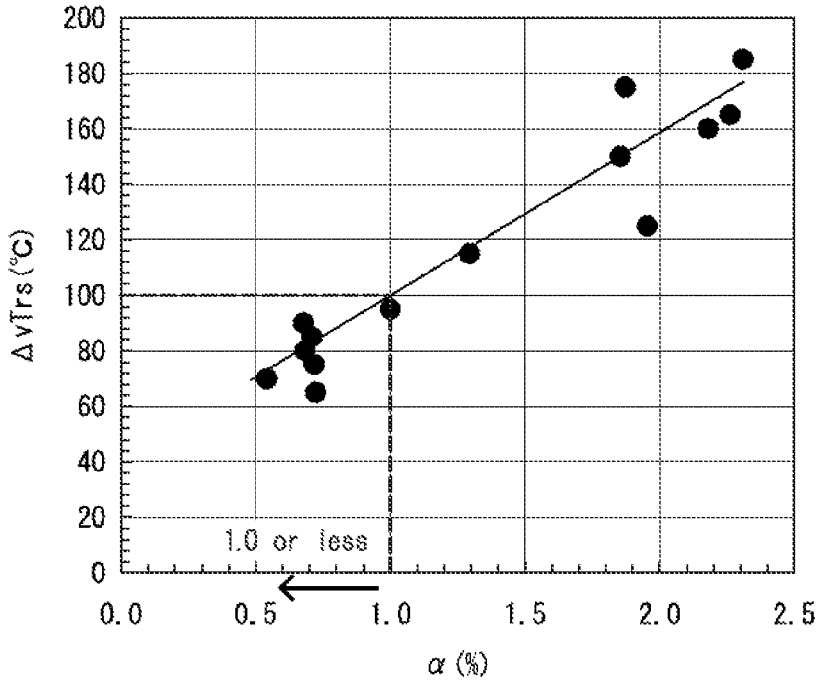
FIG. 3 is a graph showing the relationship between an α value and an SR embrittlement degree (ΔvTrs)
Figure 4:
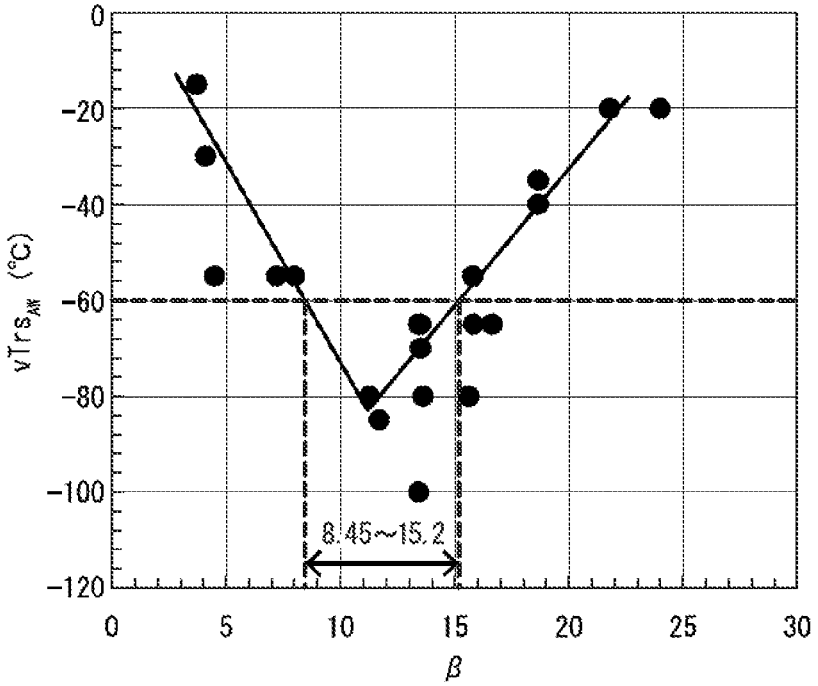
FIG. 4 is a graph showing the relationship between a β value and a transition temperature ($vTrs_{AW}$) subjected to a heat cycle.

In addition to the limitation on the amount of each of the elements, in this embodiment, as illustrated in FIGS. 3 and 4, the ranges of two index values, an α value and a β value are limited.

(α Value: 0.13 to 1.0 Mass %)

The α value is expressed by the following expression 2.

$$\alpha = \text{'C'} + 6\times\text{'Si'} + 100\times\text{'P'} \quad \text{(expression 2)}$$

'C', 'Si', and 'P' are respectively the amounts (mass %) of C, Si, and P in the steel. In this embodiment, the upper limit of the α value is 1.0 mass %. This is a condition necessary for the SR embrittlement degree (ΔvTrs) of the weld heat affected zone to be 100° C. or less in order to improve the toughness of a coarse-grained region of the weld heat affected zone after SR as illustrated in FIG. 3, and the amounts of C, Si, and P need to be adjusted within a range which satisfies the condition. In order to enhance the toughness after the SR, if necessary, the upper limit of the α value may be 0.9 mass %, 0.85 mass %, 0.8 mass %, 0.75 mass %, 0.7 mass %, 0.65 mass %, or 0.6 mass %.

The lower limit of the α value is 0.13 mass %. The lower limit thereof is calculated by substituting the above-described lower limits of the amounts of C, Si, and P in expression 2. The preferable lower limit of the α value may be calculated from the preferable lower limits of the amounts of C, Si, and P.

(β Value: 8.45 to 15.2)

The β value is calculated by the following expression 3.

$$\beta = 0.65\times\text{'C'}^{1/2}\times(1+0.64\times\text{'Si'})\times(1+4.10\times\text{'Mn'})\times(1+0.27\times\text{'Cu'})\times(1+0.52\times\text{'Ni'})\times(1+2.33\times\text{'Cr'})\times(1+3.14\times\text{'Mo'}) \quad \text{(expression 3)}$$

'C', 'Si', 'Mn', 'Cu', 'Ni', 'Cr', and 'Mo' indicate the amounts (mass %) of C, Si, Mn, Cu, Ni, Cr, and Mo in a steel. In this embodiment, the range of the β value is 8.45 to 15.2. As illustrated in FIG. 4, this is an index of the amount of an alloy element which is necessary for causing the toughness ($vTrs_{AW}$) just as subjected to a heat cycle to be −60° C. or less. If necessary, the lower limit of the β value may be 9.0, 9.5, 10.0, or 10.5. At the same time, the upper limit of the β value may be 14.5, 14.0, 13.5, or 13.0.

When both the numerical value range regarding the α value and the numerical value range regarding the β value are satisfied, a steel in which the CTOD properties of a weld heat affected zone are excellent even after SR can be provided.

In addition, in the steel plate according to this embodiment, a carbon equivalent Ceq which is calculated by the following expression 4 and is an index that indicates the hardenability of the steel may be 0.50 to 0.80%.

$$\text{Ceq} = \text{'C'} + \text{'Mn'}/6 + \text{'Cu'}/15 + \text{'Ni'}/15 + \text{'Cr'}/5 + \text{'Mo'}/5 + \text{'V'}/5 \quad \text{(expression 4)}$$

In a case where the Ceq is less than 0.50%, there may be cases where the strength of the steel is insufficient. If necessary, the lower limit of the Ceq may be 0.53%, 0.56%, 0.58%, or 0.60%. In addition, in a case where the Ceq is more than 0.75%, there may be cases where the toughness of the steel is reduced. If necessary, the upper limit of the Ceq may be 0.72%, 0.69%, 0.67%, or 0.65%.

(Average Grain Size at ½t of Steel Plate: 35 μm or Less)

In this embodiment, the upper limit of an average grain size at mid-thickness (½t) of the steel plate is 35 μm. In order to enhance toughness after the SR, if necessary, the upper limit of the average grain size may be 30 μm, 25 μm, 22 μm, or 19 μm. In addition, the average grain size at ½t of the steel plate is preferably small, and thus the lower limit thereof does not need to be specified. Typically, the minimum average grain size is about 10 μm.

(Yield Strength: 670 to 870 N/mm$^2$)

(Tensile Strength: 780 to 940 N/mm$^2$)

In this embodiment, the yield strength of the steel plate is 670 to 870 N/mm$^2$, and a tensile strength of the steel plate is 780 to 940 N/mm$^2$. In order to reduce the weight of a large welded structure of a storage tank container, construction equipment, offshore construction, a large crane for ships, and the like, a steel plate capable of securing the strength of the structure even with a small plate thickness is needed. Typically, the steel plate having the yield strength and the tensile strength described above is selected as the steel plate which is used for such applications, and thus the steel plate in this embodiment is also manufactured to have the yield strength and the tensile strength described above. If necessary, the lower limit of the yield strength may be 690 N/mm$^2$, and the upper limit thereof may be 830 N/mm$^2$. The lower limit of the tensile strength may be 800 N/mm$^2$, and the upper limit thereof may be 900 N/mm$^2$.

(Plate Thickness: 25 to 200 mm)

In a case of welding a steel plate having a plate thickness of less than 25 mm, SR is generally unnecessary. The object of the present invention is a steel plate which needs the SR, and thus the lower limit of the plate thickness in this embodiment is 25 mm. In addition, in the steel plate having a plate thickness of more than 200 mm, a cooling rate of ½t is significantly reduced, resulting in coarsening of a microstructure. Therefore, there is a high possibility that the weld and the heat affected zone may not satisfy predetermined strength and toughness. Accordingly, the plate thickness of the steel plate according to this embodiment is 200 mm or less. A CTOD value after the SR is reduced as the plate thickness is increased. Therefore, if necessary, the lower limit of the plate thickness may be 50 mm or 75 mm, and the upper limit of the plate thickness may be 150 mm or 125 mm.

A method of manufacturing the steel plate according to this embodiment will be described below.

In order to manufacture the steel plate from the steel having the above-described composition, a typical manufacturing method of iron and steel products is used. That is, a steel, which is manufactured by a converter method or an electric furnace method and is then refined by a secondary refining facility, is formed into a slab by continuous casting or ingot casting and cogging. Thereafter, it is preferable that the slab be heated (reheated) to about 950 to 1250° C. by a slab heating furnace and then be rolled to have a predetermined plate thickness by hot rolling so as to be formed into the steel plate. Furthermore, quenching and tempering are performed on the steel plate to obtain a steel plate (final steel plate) having predetermined properties.

When the heating temperature (reheating temperature) before the rolling is higher than 1250° C., the average grain size increases. Particularly, when a steel plate having a plate thickness of more than 100 mm is manufactured, the tendency becomes significant. Therefore, it is preferable that the upper limit of the heating temperature before the rolling be 1250° C. In addition, when the heating temperature before the rolling is less than 950° C., low temperature rolling is performed during the rolling, and thus a reduction per one pass is reduced. Accordingly, a sufficient reduction efficiency cannot be achieved in the vicinity of ½t. Therefore, it is preferable that the lower limit of the heating temperature before the rolling be 950° C.

During the rolling, in order to cause the structure of the steel plate to be a microstructure having an average grain size of 35 μm or less, it is preferable that a cumulative rolling reduction be 50% or more at a rolling temperature in a range of 1150 to 900° C. In a case where a direct quenching treatment in which direct water cooling is performed is performed on the steel plate after the hot rolling, it is preferable that the cumulative rolling reduction at a rolling temperature in a range of 1150 to 900° C. be 50% or more.

In a case where the plate thickness is less than 50 mm, the direct quenching treatment in which direct water cooling is performed may be performed after the hot rolling. In a case where the direct quenching treatment is performed, a cooling start temperature is set to an Ar3 point or higher, and water cooling is performed on reach 300° C. or less. It is preferably that the average cooling rate during the cooling be 5° C./s or more.

In a case where the plate thickness is 50 mm or more, in order to ensure a structure having an average grain size of 35 μm or less at ½t, direct quenching after the hot rolling is not preferable. In the case where the plate thickness is 50 mm or more, it is preferable that the quenching treatment be performed by temporarily cooling the steel plate after the rolling and then reheating the steel plate.

In a case where the reheating is performed, it is preferable that a heating temperature during the quenching treatment (that is, quenching temperature) be 930° C. or less. This is because the structure of a thick steel plate may not be sufficiently refined after the rolling. When the quenching temperature applied to the steel plate in which the structure is not sufficiently refined is higher than 930° C., there may be cases where the average grain size after the tempering may not be equal to or less than 35 μm which is postulated in this embodiment. In order to further reduce the average grain size, it is preferable that the quenching temperature be a temperature which is slightly higher than the Ac3 point (for example, in a temperature range of the Ac3 point or higher and the Ac3 point+20° C. or less). In addition, in the description of the quenching treatment conditions described above, it is postulated that the plate thickness of the steel plate is 50 mm or more. However, the quenching treatment conditions are also applied to a case where reheating and quenching are performed on the steel plate having a plate thickness of less than 50 mm.

In a case where the cooling is performed after the tempering, in order to prevent a reduction in the toughness of the base metal due to tempering embrittlement, it is preferable that the steel plate be cooled by water cooling (accelerated cooling is performed) instead of air cooling which is typically used. In this case, it is preferable that the average cooling rate to 300° C. be 0.1° C./s or more or 0.5° C./s or more.

The steel plate according to this embodiment can obtain toughness such that a charpy absorbed energy at −40° C. $vE_{-40}$ is 100 J or more even when SR is performed with a holding temperature of 560° C., a holding time of h hours (hr) defined by the following expressions 5 and 6, a rate of temperature increase within a temperature range of 425° C. or more and a rate of temperature decrease within the temperature range of 425° C. or more of 55° C./hour or less.

$$\text{when } t \geq 50,\ h = t/25 \qquad \text{(expression 5)}$$

$$\text{when } t < 50,\ h = 2 \qquad \text{(expression 6)}$$

In expressions 5 and 6, t indicates the plate thickness of the steel plate in terms of mm and h indicates the holding time in unit of hour. The above-described SR conditions are based on the contents specified in "Methods of post weld heat treatment" of JIS Z3700-2009.

EXAMPLES

In order to check the effects of chemical compositions, α values, and β values on the base metal and the heat affected zone, steel plates of Test Nos. 1 to 39 described below were produced.

Slabs which were obtained by melting steels of A1 to A11 and B1 to B27 which had chemical compositions shown in Table 1-1 and Table 1-2 were formed into steel plates having plate thicknesses of 25 to 150 mm under the manufacturing conditions of Examples corresponding to Test Nos. 1 to 12 shown in Table 2-1 and under the manufacturing conditions of Comparative Examples corresponding to Test Nos. 13 to 39 shown in Table 2-2. In addition, in Table 1-1 and Table 1-2, blanks indicate that elements corresponding thereto were not contained at all or only small amounts of elements regarded as merely impurities were contained.

During the manufacturing, the slabs were heated at a heating temperature of 950 to 1250° C. and then hot-rolled. Thereafter, air cooling was performed to 100° C. or less or water cooling was performed to 100° C. or less. Thereafter, except for the steel plates of Test Nos. 9 and 18, a typical quenching treatment and a tempering treatment were performed. In addition, for the steel plates of Test Nos. 9 and 18, a water cooling treatment was performed immediately after the hot rolling such that quenching was omitted and only the tempering treatment was performed.

Thereafter, No. 14 tensile test specimens specified in JIS Z 2201 were machined from ¼t of all the steel plates, and a tensile test specified in JIS Z 2241 was performed on the test specimens to obtain the yield strengths of the test specimens as base metals before SR and the tensile strengths of the base metals. The test specimens having a yield strength of 670 to 870 $N/mm^2$ and a tensile strength of 780 to 940 $N/mm^2$ were determined to be accepted.

Furthermore, SR was performed on all the steel plates, three charpy impact test specimens were machined from each of the steel plates on the basis of JIS Z 2242, and a charpy impact test was performed on each of the test specimens. A charpy impact test temperature was −40° C.

The average value of three absorbed energies obtained as such was described in Table 2-1 and Table 2-2 as the $vE_{-40}$ of the base metal. The steel plate in which the charpy absorbed energy of the base metal after a stress annealing was 100 J or more was accepted. In addition, a heating holding temperature during SR in each test specimen uses the value described in Table 2-3 and Table 2-4, and a holding time was a 'plate thickness (mm)/25' hour. However, a heating holding time during SR in the test specimen having a plate thickness of less than 50 mm was 2 hours.

In addition, for the purpose of evaluating the toughness of the welded joint, welding was performed on each test steel by arc welding (SMAW), gas-shielded metal-arc welding (GMAW), or submerged arc welding (SAW) to produce a butt joint having double bevel groove. The weld heat input was 1.1 to 4.5 kJ/mm. In a case where such welding is performed, a cooling rate in a temperature range of 800° C. to 500° C. after the welding is 5 to 60° C./s. Thereafter, the welded joint was heated and held at a predetermined temperature shown in Table 2-3 and Table 2-4 (holding time: plate thickness (mm)/25 hours), and then SR was performed by cooling the joint to 400° C. or less at a cooling rate within a range of 50 to 40° C./hour and thereafter cooling the joint to a room temperature through air cooling. Thereafter, an impact test specimen based on JIS Z 3128 and a CTOD test specimen (B×2B type based on BS 7448) were machined from the sample subject to the welding and SR. A cutout position of the impact test specimen was within 0.5 mm or less of a fusion line. Regarding the machining of the CTOD test specimen, full thickness test specimen of which 'B' is the plate thickness was produced from the steel plate having a plate thickness of 50 mm or less, and a reduced thickness test specimen of which 'B' is 50 mm was produced from the steel plate having a plate thickness of more than 50 mm by reducing the thickness thereof to 50 mm.

In Examples and Comparative Examples, a holding temperature in SR was 560° C. or higher. In a case where the holding temperature is high, the SR embrittlement degree of the weld heat affected zone due to SR is increased. Therefore, the steel plate in which SR was performed under the condition of a holding temperature of higher than 560° C. and thus good results were obtained also could obtain good results even when SR is performed thereto under the condition of a holding temperature of 560° C.

In the charpy impact test of the weld heat affected zone after the stress annealing, the test was conducted at a test temperature of −40° C. on the above-described test specimen using three test specimens machined therefrom. The average value of three mpact absorbed energies obtained as such was calculated. A test specimen in which the average value of the three impact absorbed energies of the weld heat affected zone after the stress annealing was 50 J or more was accepted.

In the CTOD test, the test temperature was corrected according to the presence or absence of a reduction in thickness. Specifically, in the reduced thickness test specimen, in order to remove a thickness effect which occurs due to the difference between the plate thickness of the test steel plate and the plate thickness of the test specimen (B=50 mm), the test temperature was corrected according to a plate thickness effect correction expression specified in WES 3003 of the Japan Welding Engineering Society. The test temperature of all the test specimens which were not reduced in thickness (full thickness test specimens) was −10° C. The test temperature of the test specimen which was reduced in thickness (reduced thickness test specimen) was a temperature obtained by adding a correction temperature which was obtained by a formula "'correction temperature'=6×('plate thickness of reduced thickness test specimen'$^{1/2}$−'plate thickness of test steel plate'$^{1/2}$)", to the above-described test temperature of the overall thickness test specimen. For example, in a case of a steel plate having an original thickness (plate thickness of the test steel plate) of 75 mm, the charpy impact test was performed at a test temperature of −20° C. (a value obtained by rounding off −19.5 to the nearest integer) which was a temperature obtained by adding the correction temperature corresponding to the plate thickness effect ($6\times(50^{1/2}-75^{1/2})=-9.5$° C.) to a test temperature of the full thickness test specimen of −10° C. Since the effect of the presence or absence of the reduction in thickness was removed as described above, the CTOD test was conducted to all the test specimens substantially under the condition of a test temperature of −10° C. Even in the CTOD test, the test was performed three times to each of the test specimens to obtain CTOD values, the average value of the three times test results was described as 6c in Table 2-3 and Table 2-4. A test specimen in which the average CTOD value δc of the weld heat affected zone after SR was 0.15 mm or more was accepted. In addition, in the steel plate in which the average CTOD value δc of the weld heat affected zone after SR satisfies the acceptance criteria, it can be seen that the SR embrittlement degree (ΔvTrs) of the weld heat affected zone is 100° C. or less and the charpy transition temperature ($vTrs_{AW}$) of the weld heat affected zone before SR is −60° C. or less.

Figure 2:
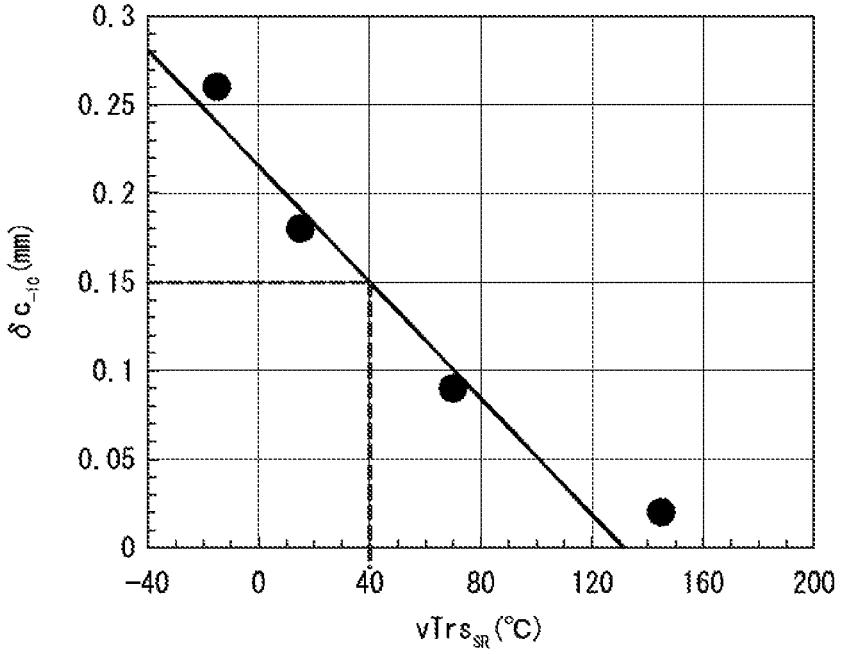
FIG. 2 is a graph showing the relationship between a charpy transition temperature ($vTrs_{SR}$) of a test specimen after SR, which is subjected to a synthetic thermal cycle, and CTOD properties ($\delta c_{-10}$) of an actual welded joint after SR.

In addition, in the tables for reference, a composition ratio of a microstructure of each test steel after welding was also described. A structure of a coarse-grained region in the vicinity of the fusion line at ¼t of the plate thickness was machined as an observation sample, and the observation sample was immersed in 10% Nital etchant. In addition, twenty areas thereof were observed by a scanning electron microscope under the condition of a magnification of 2,000-fold, and particularly, the structure ratios of an upper bainite (Bu) structure, a lower bainite (BL) structure, and a martensite (M) structures were obtained in view of the difference in generation behavior between ferrite and cementite. A method of identifying the upper bainite (Bu), the lower bainite (BL), and the martensite (M) in a microstructure photograph obtained by the scanning electron microscope is well known. For example, as described in FIG. 2 in "Materia Japan", Vol. 46, No. 5 (2007), p. 321 (Iron and Steel Institute of Japan), Bu, BL, and M are easily identified by comparing the properties of the microstructures of Bu, BL, and M.

In addition, chemical composition values, α values, and β values which are underlined in Table 1-1 and Table 1-2 are out of the range of the present invention. Numerical values of the manufacturing conditions which are underlined in Table 2-1 and Table 2-4 are out of the range of the present invention, and the property values which are underlined did not satisfy the values required by the present invention.

TABLE 1-1

| STEEL | C | Si | Mn | P | S | Cu | Ni | Cr | Mo | V | Al |
|---|---|---|---|---|---|---|---|---|---|---|---|
| A1 | 0.09 | 0.05 | 0.98 | 0.003 | 0.002 | | 2.13 | 0.75 | 0.42 | 0.030 | 0.052 |
| A2 | 0.08 | 0.09 | 0.76 | 0.002 | 0.001 | 0.57 | 2.58 | 0.57 | 0.49 | 0.015 | 0.065 |

TABLE 1-1-continued

| | | | | | | | | | | | |
|---|---|---|---|---|---|---|---|---|---|---|---|
| A3 | 0.07 | 0.02 | 1.15 | 0.004 | 0.002 | 0.43 | 0.54 | 0.86 | 0.45 | 0.045 | 0.068 |
| A4 | 0.10 | 0.02 | 0.59 | 0.006 | 0.001 | | 3.12 | 0.65 | 0.39 | 0.032 | 0.072 |
| A5 | 0.09 | 0.04 | 0.75 | 0.004 | 0.003 | 0.36 | 2.15 | 1.42 | 0.25 | 0.042 | 0.062 |
| A6 | 0.08 | 0.05 | 0.57 | 0.003 | 0.001 | 0.42 | 1.24 | 0.55 | 0.95 | 0.053 | 0.015 |
| A7 | 0.09 | 0.02 | 0.88 | 0.002 | 0.002 | 0.28 | 1.09 | 0.68 | 0.55 | 0.068 | 0.065 |
| A8 | 0.09 | 0.04 | 0.98 | 0.004 | 0.002 | 0.25 | 1.05 | 0.57 | 0.38 | 0.042 | 0.052 |
| A9 | 0.08 | 0.04 | 1.08 | 0.001 | 0.002 | | 2.43 | 0.72 | 0.46 | 0.032 | 0.095 |
| A10 | 0.09 | 0.02 | 1.42 | 0.002 | 0.002 | | 3.05 | 0.25 | 0.18 | 0.015 | 0.056 |
| A11 | 0.09 | 0.02 | 0.96 | 0.002 | 0.001 | 0.24 | 2.08 | 0.73 | 0.42 | 0.035 | 0.066 |

| STEEL | B | N | others | α VALUE | β VALUE | Ceq | REMARK |
|---|---|---|---|---|---|---|---|
| A1 | 0.0010 | 0.0042 | | 0.69 | 13.56 | 0.64 | CHEMICAL |
| A2 | 0.0009 | 0.0057 | | 0.82 | 12.78 | 0.63 | COMPOSI- |
| A3 | 0.0008 | 0.0065 | Ca: 0.0005 | 0.59 | 10.31 | 0.60 | TION OF |
| A4 | 0.0010 | 0.0052 | | 0.82 | 10.44 | 0.62 | EXAM- |
| A5 | 0.0007 | 0.0077 | | 0.73 | 14.57 | 0.72 | PLE |
| A6 | 0.0011 | 0.0034 | Ti: 0.013 | 0.68 | 10.54 | 0.60 | STEEL |
| A7 | 0.0008 | 0.0035 | Mg: 0.0012 | 0.41 | 10.81 | 0.59 | |
| A8 | 0.0017 | 0.0072 | | 0.73 | 8.46 | 0.54 | |
| A9 | 0.0017 | 0.0093 | Nb: 0.021 | 0.42 | 15.16 | 0.66 | |
| A10 | 0.0012 | 0.0059 | REM: 0.0019 | 0.41 | 8.63 | 0.62 | |
| A11 | 0.0009 | 0.0049 | | 0.41 | 13.53 | 0.64 | |

UNIT: mass %

TABLE 1-2

| STEEL | C | Si | Mn | P | S | Cu | Ni | Cr | Mo | V | Al |
|---|---|---|---|---|---|---|---|---|---|---|---|
| B1 | 0.06 | 0.04 | 1.35 | 0.002 | 0.002 | | 1.54 | 0.63 | 0.43 | 0.042 | 0.031 |
| B2 | 0.13 | 0.05 | 1.02 | 0.005 | 0.002 | 0.35 | 1.11 | 0.75 | 0.38 | 0.019 | 0.027 |
| B3 | 0.07 | 0.12 | 0.99 | 0.002 | 0.001 | | 2.54 | 0.65 | 0.43 | 0.036 | 0.053 |
| B4 | 0.10 | 0.02 | 1.45 | 0.007 | 0.002 | 0.45 | 1.59 | 0.55 | 0.35 | 0.022 | 0.069 |
| B5 | 0.09 | 0.05 | 1.00 | 0.004 | 0.005 | | 2.02 | 0.45 | 0.42 | 0.032 | 0.056 |
| B6 | 0.10 | 0.08 | 0.41 | 0.003 | 0.001 | 0.12 | 1.85 | 0.88 | 0.45 | 0.045 | 0.051 |
| B7 | 0.09 | 0.05 | 1.72 | 0.004 | 0.001 | | 0.85 | 0.45 | 0.35 | 0.025 | 0.074 |
| B8 | 0.09 | 0.07 | 1.34 | 0.003 | 0.002 | 0.28 | 0.42 | 0.85 | 0.33 | 0.042 | 0.065 |
| B9 | 0.09 | 0.04 | 0.86 | 0.002 | 0.002 | | 3.98 | 0.57 | 0.25 | 0.019 | 0.029 |
| B10 | 0.08 | 0.07 | 1.21 | 0.004 | 0.001 | | 1.86 | 0.09 | 0.69 | 0.035 | 0.056 |
| B11 | 0.09 | 0.08 | 1.05 | 0.004 | 0.002 | | 0.85 | 1.64 | 0.25 | 0.026 | 0.063 |
| B12 | 0.08 | 0.07 | 1.43 | 0.003 | 0.002 | | 1.75 | 0.86 | 0.05 | 0.019 | 0.074 |
| B13 | 0.09 | 0.05 | 0.61 | 0.001 | 0.001 | 0.25 | 1.15 | 0.65 | 1.18 | 0.044 | 0.077 |
| B14 | 0.07 | 0.07 | 1.38 | 0.003 | 0.002 | | 1.36 | 0.59 | 0.25 | 0.002 | 0.061 |
| B15 | 0.09 | 0.06 | 1.26 | 0.005 | 0.002 | | 0.99 | 0.65 | 0.29 | 0.095 | 0.065 |
| B16 | 0.09 | 0.03 | 1.05 | 0.003 | 0.001 | | 1.56 | 0.55 | 0.33 | 0.053 | 0.008 |
| B17 | 0.09 | 0.07 | 1.06 | 0.004 | 0.001 | 0.39 | 1.21 | 0.65 | 0.36 | 0.042 | 0.156 |
| B18 | 0.09 | 0.07 | 0.98 | 0.003 | 0.002 | | 3.28 | 0.65 | 0.26 | 0.033 | 0.066 |
| B19 | 0.09 | 0.05 | 0.98 | 0.004 | 0.001 | | 1.55 | 0.65 | 0.38 | 0.029 | 0.052 |
| B20 | 0.09 | 0.07 | 0.98 | 0.003 | 0.002 | 0.42 | 0.83 | 0.65 | 0.42 | 0.047 | 0.065 |
| B21 | 0.09 | 0.07 | 1.43 | 0.003 | 0.003 | | 0.69 | 0.65 | 0.27 | 0.038 | 0.042 |
| B22 | 0.10 | 0.06 | 0.98 | 0.004 | 0.003 | 1.29 | 1.21 | 0.65 | 0.25 | 0.027 | 0.029 |
| B23 | 0.10 | 0.09 | 0.98 | 0.004 | 0.003 | | 1.32 | 0.65 | 0.32 | 0.033 | 0.029 |
| B24 | 0.09 | 0.07 | 0.86 | 0.003 | 0.002 | 0.15 | 1.12 | 0.54 | 0.35 | 0.023 | 0.066 |
| B25 | 0.09 | 0.05 | 1.26 | 0.002 | 0.001 | | 1.59 | 0.75 | 0.56 | 0.025 | 0.073 |
| B26 | 0.10 | 0.08 | 0.89 | 0.005 | 0.002 | 0.32 | 1.23 | 0.63 | 0.25 | 0.042 | 0.045 |
| B27 | 0.10 | 0.10 | 1.26 | 0.004 | 0.001 | | 1.59 | 0.75 | 0.56 | 0.025 | 0.073 |

| STEEL | B | N | others | α VALUE | β VALUE | Ceq | REMARK |
|---|---|---|---|---|---|---|---|
| B1 | 0.0010 | 0.0031 | | 0.50 | 11.05 | 0.61 | CHEMICAL |
| B2 | 0.0009 | 0.0044 | | 0.93 | 13.04 | 0.63 | COMPOSI- |
| B3 | 0.0008 | 0.0025 | Ca: 0.0012 | 0.99 | 12.85 | 0.63 | TION OF |
| B4 | 0.0011 | 0.0051 | | 0.92 | 14.19 | 0.66 | COMPAR- |
| B5 | 0.0009 | 0.0048 | | 0.79 | 10.00 | 0.57 | ATIVE |
| B6 | 0.0011 | 0.0032 | | 0.88 | 8.64 | 0.57 | STEEL |
| B7 | 0.0012 | 0.0052 | | 0.79 | 10.05 | 0.60 | |
| B8 | 0.0011 | 0.0041 | Ca: 0.0011 | 0.81 | 10.52 | 0.60 | |
| B9 | 0.0009 | 0.0057 | | 0.53 | 11.55 | 0.67 | |
| B10 | 0.0009 | 0.0050 | | 0.90 | 8.63 | 0.57 | |
| B11 | 0.0012 | 0.0038 | | 0.97 | 13.49 | 0.70 | |
| B12 | 0.0008 | 0.0031 | | 0.80 | 8.75 | 0.62 | |
| B13 | 0.0013 | 0.0046 | | 0.49 | 14.22 | 0.66 | |
| B14 | 0.0009 | 0.0049 | Nb: 0.025 | 0.79 | 8.66 | 0.56 | |
| B15 | 0.0010 | 0.0047 | | 0.95 | 9.09 | 0.57 | |
| B16 | 0.0010 | 0.0051 | | 0.57 | 8.87 | 0.56 | |

TABLE 1-2-continued

| | | | | | | |
|---|---|---|---|---|---|---|
| B17 | 0.0009 | 0.0058 | | 0.91 | 10.51 | 0.58 |
| B18 | 0.0002 | 0.0035 | Ti: 0.012 | 0.81 | 12.63 | 0.66 |
| B19 | 0.0027 | 0.0034 | | 0.79 | 10.06 | 0.57 |
| B20 | 0.0010 | 0.0015 | | 0.81 | 9.50 | 0.56 |
| B21 | 0.0009 | 0.0135 | | 0.81 | 8.83 | 0.57 |
| B22 | 0.0011 | 0.0039 | | 0.86 | 10.56 | 0.62 |
| B23 | 0.0009 | 0.0039 | | 1.04 | 9.27 | 0.55 |
| B24 | 0.0014 | 0.0033 | | 0.81 | 7.20 | 0.50 |
| B25 | 0.0011 | 0.0047 | | 0.59 | 17.18 | 0.67 |
| B26 | 0.0013 | 0.0072 | REM: 0.0015 | 1.08 | 7.88 | 0.54 |
| B27 | 0.0011 | 0.0047 | | 1.10 | 18.67 | 0.68 |

UNIT: mass %

TABLE 2-1

| | | METHOD FOR MANUFACTURING STEEL SHEET | | | | | PROPERTIES OF BASE METAL | | | |
|---|---|---|---|---|---|---|---|---|---|---|
| TEST NUMBER | STEEL | REHEATING TEMPERATURE (° C.) | COOLING TO 100° C. AFTER ROLLING | PLATE THICKNESS (mm) | QUENCHING TEMPERATURE (° C.) | TEMPERING TEMPERATURE (° C.) | YIELD STRENGTH ($N/mm^2$) | TENSILE STRENGTH ($N/mm^2$) | IMPACT TEST * $vE_{-40}$ (J) | REMARK |
| 1 | A1 | 1150 | AIR COOLING | 50 | 910 | 620 | 753 | 825 | 185 | EXAMPLE |
| 2 | A2 | 1200 | AIR COOLING | 75 | 910 | 620 | 728 | 792 | 215 | |
| 3 | A3 | 1250 | AIR COOLING | 120 | 910 | 620 | 783 | 850 | 212 | |
| 4 | A4 | 1150 | AIR COOLING | 50 | 910 | 620 | 816 | 886 | 263 | |
| 5 | A5 | 1150 | AIR COOLING | 95 | 910 | 620 | 746 | 824 | 215 | |
| 6 | A5 | 1150 | WATER COOLING | 95 | 910 | 620 | 774 | 835 | 173 | |
| 7 | A6 | 1250 | AIR COOLING | 50 | 910 | 620 | 836 | 904 | 193 | |
| 8 | A7 | 1200 | AIR COOLING | 50 | 920 | 630 | 690 | 810 | 226 | |
| 9 | A8 | 1050 | WATER COOLING | 25 | — | 620 | 753 | 846 | 215 | |
| 10 | A9 | 1250 | AIR COOLING | 150 | 930 | 620 | 830 | 906 | 230 | |
| 11 | A10 | 950 | AIR COOLING | 50 | 920 | 635 | 802 | 873 | 208 | |
| 12 | A11 | 1150 | AIR COOLING | 50 | 910 | 620 | 811 | 882 | 206 | |

* AFTER STRESS RELIEFE ANNEALING

TABLE 2-2

| | | METHOD FOR MANUFACTURING STEEL SHEET | | | | | PROPERTIES OF BASE METAL | | | |
|---|---|---|---|---|---|---|---|---|---|---|
| TEST NUMBER | STEEL | REHEATING TEMPERATURE (° C.) | COOLING TO 100° C. AFTER ROLLING | PLATE THICKNESS (mm) | QUENCHING TEMPERATURE (° C.) | TEMPERING TEMPERATURE (° C.) | YIELD STRENGTH ($N/mm^2$) | TENSILE STRENGTH ($N/mm^2$) | IMPACT TEST * $vE_{-40}$ (J) | REMARK |
| 13 | B1 | 1050 | AIR COOLING | 50 | 910 | 610 | 706 | 765 | 215 | COMPARATIVE EXAMPLE |
| 14 | B2 | 1150 | AIR COOLING | 25 | 910 | 620 | 759 | 826 | 211 | |
| 15 | B3 | 1050 | AIR COOLING | 50 | 910 | 640 | 768 | 845 | 215 | |
| 16 | B4 | 1050 | AIR COOLING | 120 | 910 | 620 | 765 | 842 | 105 | |
| 17 | B5 | 1050 | AIR COOLING | 50 | 910 | 620 | 752 | 812 | 96 | |
| 18 | B6 | 1050 | WATER COOLING | 50 | — | 630 | 695 | 752 | 106 | |
| 19 | B7 | 1150 | AIR COOLING | 50 | 910 | 620 | 756 | 815 | 215 | |
| 20 | B8 | 1150 | AIR COOLING | 50 | 905 | 625 | 776 | 842 | 49 | |
| 21 | B9 | 1150 | AIR COOLING | 50 | 910 | 615 | 756 | 810 | 242 | |
| 22 | B10 | 1150 | AIR COOLING | 75 | 920 | 635 | 744 | 756 | 215 | |
| 23 | B11 | 1050 | AIR COOLING | 50 | 910 | 635 | 856 | 925 | 76 | |
| 24 | B12 | 1050 | AIR COOLING | 35 | 920 | 630 | 674 | 743 | 106 | |
| 25 | B13 | 1050 | AIR COOLING | 100 | 910 | 620 | 885 | 957 | 108 | |
| 26 | B14 | 1050 | AIR COOLING | 50 | 920 | 610 | 716 | 775 | 224 | |
| 27 | B15 | 1050 | AIR COOLING | 50 | 910 | 620 | 793 | 864 | 145 | |
| 28 | B16 | 1050 | AIR COOLING | 70 | 910 | 640 | 667 | 725 | 82 | |
| 29 | B17 | 1050 | AIR COOLING | 35 | 910 | 620 | 832 | 899 | 168 | |
| 30 | B18 | 1050 | AIR COOLING | 50 | 910 | 620 | 625 | 715 | 53 | |
| 31 | B19 | 1100 | AIR COOLING | 50 | 915 | 625 | 684 | 772 | 86 | |
| 32 | B20 | 1100 | AIR COOLING | 45 | 910 | 620 | 819 | 886 | 83 | |
| 33 | B21 | 1100 | AIR COOLING | 50 | 910 | 620 | 638 | 764 | 42 | |
| 34 | B22 | 1100 | AIR COOLING | 50 | 910 | 585 | 885 | 984 | 29 | |
| 35 | B23 | 1100 | AIR COOLING | 50 | 920 | 635 | 712 | 775 | 215 | |
| 36 | B24 | 1100 | AIR COOLING | 50 | 910 | 620 | 730 | 795 | 221 | |
| 37 | B25 | 1050 | AIR COOLING | 150 | 920 | 635 | 806 | 873 | 211 | |

TABLE 2-2-continued

| | | METHOD FOR MANUFACTURING STEEL SHEET | | | | | PROPERTIES OF BASE METAL | | | |
|---|---|---|---|---|---|---|---|---|---|---|
| TEST NUMBER | STEEL | REHEATING TEMPERATURE (° C.) | COOLING TO 100° C. AFTER ROLLING | PLATE THICKNESS (mm) | QUENCHING TEMPERATURE (° C.) | TEMPERING TEMPERATURE (° C.) | YIELD STRENGTH ($N/mm^2$) | TENSILE STRENGTH ($N/mm^2$) | IMPACT TEST * $vE_{-40}$ (J) | REMARK |
| 38 | B26 | 1050 | AIR COOLING | 50 | 910 | 620 | 735 | 799 | 183 | |
| 39 | B27 | 1050 | AIR COOLING | 150 | 910 | 620 | 851 | 921 | 56 | |

* AFTER STRESS RELIEFE ANNEALING

TABLE 2-3

| | | WELD CONDITION AND STRESS RELIEFE CONDITION | | | | | | |
|---|---|---|---|---|---|---|---|---|
| TEST NO. | STEEL | METHOD FOR WELDING | HEAT INPUT (kJ/mm) | COOLING RATE FROM 800° C. TO 500° C. (° C./s) | RATIO OF MICROSTRUCTURE (area %) Bu | BL | M | HEATING HOLDING TEMPERATURE (° C.) |
| 1 | A1 | SMAW | 2.5 | 19 | 10 | 70 | 20 | 590 |
| 2 | A2 | SMAW | 2.5 | 19 | 10 | 80 | 10 | 590 |
| 3 | A3 | SMAW | 2.5 | 19 | 10 | 80 | 10 | 560 |
| 4 | A4 | SMAW | 2.5 | 19 | 10 | 80 | 10 | 590 |
| 5 | A5 | SAW | 4.5 | 9 | 20 | 80 | 0 | 560 |
| 6 | A5 | SMAW | 3.0 | 15 | 10 | 70 | 20 | 560 |
| 7 | A6 | SMAW | 2.5 | 19 | 20 | 70 | 10 | 560 |
| 8 | A7 | SMAW | 2.5 | 19 | 20 | 70 | 10 | 580 |
| 9 | A8 | GMAW | 1.1 | 39 | 20 | 40 | 40 | 580 |
| 10 | A9 | SAW | 4.5 | 8 | 30 | 60 | 10 | 560 |
| 11 | A10 | SMAW | 2.5 | 19 | 20 | 80 | 0 | 600 |
| 12 | A11 | SMAW | 2.5 | 19 | 10 | 70 | 20 | 600 |

| | PROPERTIES OF WELD HAZ AFTER SR | | PROPERTIES OF BASE METAL (AT THICKNESS CENTER) | | |
|---|---|---|---|---|---|
| TEST NO. | IMPACT TEST * $vE_{-40}$ (J) | CTOD TEST δc (mm) | AVERAGE GRAIN SIZE (μm) | $\Delta vTrs_{BM}$ (° C.) | REMARK |
| 1 | 178 | 0.29 | 20 | −8 | EXAMPLE |
| 2 | 208 | 0.34 | 24 | −12 | |
| 3 | 215 | 0.39 | 32 | −3 | |
| 4 | 195 | 0.31 | 20 | −7 | |
| 5 | 174 | 0.29 | 21 | −8 | |
| 6 | 189 | 0.31 | 28 | −3 | |
| 7 | 213 | 0.39 | 21 | −5 | |
| 8 | 241 | 0.52 | 19 | −12 | |
| 9 | 230 | 0.43 | 16 | −15 | |
| 10 | 219 | 0.37 | 31 | −1 | |
| 11 | 231 | 0.41 | 18 | −17 | |
| 12 | 217 | 0.45 | 16 | −14 | |

SMAW: SHIELDED METAL ARC WELDING
GMAW: GAS-SHIELDED METAL-ARC WELDING
SAW: SUBMERGED ARC WELDING
Bu: UPPER BAINITE
BL: LOWER BAINITE
M: MARTENSITE

TABLE 2-4

| | | WELD CONDITION AND STRESS RELIEFE CONDITION | | | | | | |
|---|---|---|---|---|---|---|---|---|
| TEST NO. | STEEL | METHOD FOR WELDING | HEAT INPUT (kJ/mm) | COOLING RATE FROM 800° C. TO 500° C. (° C./s) | RATIO OF MICROSTRUCTURE (area %) Bu | BL | M | HEATING HOLDING TEMPERATURE (° C.) |
| 13 | B1 | SMAW | 2.5 | 19 | 10 | 80 | 10 | 560 |
| 14 | B2 | SMAW | 2.5 | 19 | 20 | 10 | 70 | 560 |
| 15 | B3 | SAW | 4.5 | 8 | 50 | 50 | 0 | 560 |

TABLE 2-4-continued

| | | | | | | | | |
|---|---|---|---|---|---|---|---|---|
| 16 | B4 | SMAW | 2.5 | 19 | 10 | 70 | 20 | 560 |
| 17 | B5 | SMAW | 2.5 | 19 | 30 | 60 | 10 | 560 |
| 18 | B6 | SMAW | 2.5 | 19 | 70 | 30 | 0 | 560 |
| 19 | B7 | SAW | 3.5 | 10 | 40 | 20 | 40 | 560 |
| 20 | B8 | GMAW | 1.8 | 25 | 0 | 60 | 40 | 560 |
| 21 | B9 | SMAW | 2.5 | 19 | 20 | 70 | 10 | 560 |
| 22 | B10 | SMAW | 2.5 | 19 | 60 | 40 | 0 | 560 |
| 23 | B11 | SMAW | 3.0 | 15 | 40 | 20 | 40 | 560 |
| 24 | B12 | SMAW | 2.5 | 19 | 70 | 30 | 0 | 560 |
| 25 | B13 | SMAW | 2.5 | 19 | 0 | 20 | 80 | 560 |
| 26 | B14 | SMAW | 2.5 | 19 | 50 | 50 | 0 | 570 |
| 27 | B15 | SMAW | 3.5 | 10 | 70 | 20 | 10 | 560 |
| 28 | B16 | SMAW | 2.5 | 19 | 70 | 20 | 10 | 560 |
| 29 | B17 | SMAW | 2.5 | 19 | 50 | 40 | 10 | 560 |
| 30 | B18 | GMAW | 1.5 | 30 | 60 | 30 | 10 | 580 |
| 31 | B19 | SMAW | 3.0 | 15 | 20 | 80 | 10 | 560 |
| 32 | B20 | SMAW | 3.0 | 15 | 60 | 30 | 10 | 580 |
| 33 | B21 | SMAW | 3.0 | 15 | 30 | 70 | 0 | 580 |
| 34 | B22 | SMAW | 3.0 | 15 | 40 | 40 | 20 | 560 |
| 35 | B23 | SMAW | 3.0 | 15 | 30 | 70 | 0 | 580 |
| 36 | B24 | SMAW | 2.5 | 19 | 80 | 20 | 0 | 560 |
| 37 | B25 | SMAW | 3.0 | 15 | 10 | 10 | 80 | 580 |
| 38 | B26 | SMAW | 3.0 | 15 | 80 | 20 | 0 | 560 |
| 39 | B27 | SMAW | 2.5 | 19 | 0 | 20 | 80 | 560 |

| | PROPERTIES OF WELD HAZ AFTER SR | | PROPERTIES OF BASE METAL (AT THICKNESS CENTER) | | |
|---|---|---|---|---|---|
| TEST NO. | IMPACT TEST * $vE_{-40}$ (J) | CTOD TEST δc (mm) | AVERAGE GRAIN SIZE (μm) | $\Delta vTrs_{BM}$ (° C.) | REMARK |
| 13 | 168 | 0.29 | 21 | −12 | COMPARATIVE EXAMPLE |
| 14 | 95 | 0.14 | 25 | −8 | |
| 15 | 44 | 0.04 | 28 | 9 | |
| 16 | 58 | 0.06 | 32 | 14 | |
| 17 | 92 | 0.14 | 23 | 5 | |
| 18 | 148 | 0.21 | 36 | 3 | |
| 19 | 70 | 0.10 | 23 | −7 | |
| 20 | 82 | 0.14 | 29 | −3 | |
| 21 | 46 | 0.05 | 19 | −13 | |
| 22 | 189 | 0.28 | 27 | −6 | |
| 23 | 83 | 0.12 | 26 | 5 | |
| 24 | 188 | 0.32 | 18 | −8 | |
| 25 | 44 | 0.04 | 31 | 4 | |
| 26 | 164 | 0.28 | 21 | −7 | |
| 27 | 74 | 0.09 | 20 | −8 | |
| 28 | 79 | 0.11 | 48 | 10 | |
| 29 | 47 | 0.05 | 12 | −18 | |
| 30 | 231 | 0.43 | 39 | 8 | |
| 31 | 167 | 0.25 | 45 | 4 | |
| 32 | 48 | 0.13 | 38 | 5 | |
| 33 | 174 | 0.27 | 31 | −5 | |
| 34 | 85 | 0.19 | 27 | −8 | |
| 35 | 74 | 0.08 | 26 | −11 | |
| 36 | 60 | 0.06 | 24 | −10 | |
| 37 | 35 | 0.06 | 34 | −2 | |
| 38 | 84 | 0.12 | 23 | −8 | |
| 39 | 45 | 0.03 | 30 | −1 | |

SMAW: SHIELDED METAL ARC WELDING
GMAW: GAS-SHIELDED METAL-ARC WELDING
SAW: SUBMERGED ARC WELDING
Bu: UPPER BAINITE
BL: LOWER BAINITE
M: MARTENSITE

All the components and the manufacturing conditions of the steels of Test Nos. 1 to 12 in Table 2-1 and Table 2-3 are within the ranges of the present invention. In all of the steels, the tensile strength of the base metal, the yield strength of the base metal, the impact properties ($vE_{-40}$) of the base metal, the impact properties ($vE_{-40}$ and δc) of the weld heat affected zone after SR, and the SR embrittlement degree ($\Delta vTrs_{BM}$) of the base metal were good. In addition, in these steels, the toughness of the weld was also good. Good toughness is supported by the impact test results and the CTOD test results which sufficiently satisfy the above-described acceptance and rejection criteria.

The steel plates of Test Nos. 13 and 14 are comparative examples in which the amount of C is out of the specified range of the present invention. In the steel plate of Test No. 13, since the amount of C is less than 0.07%, hardness during quenching is not sufficient, and the tensile strength of the base metal did not satisfy the target value. In the steel plate of Test No. 16, since the amount of C was more than 0.1%, the strength (tensile strength and yield strength) of the base metal was good, but the toughness of the weld heat affected zone was reduced. As a result, the δc was low.

The steel plate of Test No. 15 is an example in which the amount of Si is more than the upper limit. In this case, the toughness of the weld heat affected zone after SR was significantly reduced, and thus both the absorbed energy and the δc of the weld heat affected zone after SR of the steel plate of Test No. 15 did not satisfy the acceptance criteria. In addition, since Si is an element which facilitates SR embrittlement, in the steel plate of Test No. 15, the $\Delta vTrs_{BM}$ was more than 0° C.

The steel plates of Test Nos. 16 and 17 are examples in which the amount of P and the amount of S are more than the upper limits. The steel plate of Test No. 16 contained P at a content of more than 0.005% which is the upper limit of the amount of P, and thus tempering embrittlement had occurred after SR. As a result, in the steel plate of Test No. 16, although the properties of the base metal were satisfied, the impact properties of the weld heat affected zone after SR were slightly low, and the δc of the weld heat affected zone after SR did not satisfy the target value. The steel plate of Test No. 17 is an example in which S is contained at a content of more than 0.003% that is the upper limit of the amount of S. In the steel plate of Test No. 17, MnS was generated in the steel, and thus the toughness of the base metal and the δc of the weld heat affected zone after SR did not satisfy the acceptance criteria. In addition, since P and S are elements which facilitate SR embrittlement, in the steel plates of Test Nos. 17 and 18, the $\Delta vTrs_{BM}$ was more than 0° C.

The steel plates of Test Nos. 18 and 19 are examples in which the amount of Mn is out of the specified range of the present invention. The amount of Mn of Test No. 18 is less than 0.5% which is the lower limit of the amount of Mn. In the steel plate of Test No. 18, the properties of the weld heat affected zone were satisfied, but the tensile strength of the base metal did not satisfy the acceptance criteria due to a reduction in hardenability. In addition, in the steel plate of Test No. 18, the average grain size of the base metal was out of the specified range of the present invention. In a case where the amount of Mn is too low, the hardenability of the steel is reduced, and thus the structure after the quenching becomes coarsened. In addition, it is thought that the steel plate of Test No. 18 was subjected to direct quenching and this also caused the coarsening of the structure. Since the average grain size of the base metal was out of the specified range of the present invention, in the steel plate of Test No. 18, the $\Delta vTrs_{BM}$ was more than 0° C. The steel plate of Test No. 19 is an example in which the amount of Mn is more than 1.5% which is the upper limit of the amount of Mn. Since the amount of Mn was excessive, embrittlement in the weld heat affected zone after SR became significant, and the δc of the steel plate of Test No. 19 did not satisfy the target value.

The steel plates of Test Nos. 20 and 21 are examples in which the amount of Ni is out of the specified range of the present invention. The amount of Ni of the steel plate of Test No. 20 was less than 0.5% which is the lower limit of the amount of Ni, and did not satisfy a content at which an effect of enhancing the toughness of the weld and the base metal can be obtained. Therefore, the impact absorbed energy of the base metal and the δc of the weld heat affected zone did not satisfy the acceptance criteria. The amount of Ni of the steel plate of Test No. 21 is more than 3.5% which is the upper limit of the amount of Ni. In this case, although the toughness of the base metal satisfied the acceptance criteria, sensitivity to tempering embrittlement was increased. As a result, the impact absorbed energy and the δc of the weld heat affected zone did not satisfy the acceptance criteria.

The steel plates of Test Nos. 22 and 23 are examples in which the amount of Cr is out of the specified range of the present invention. The steel plate of Test No. 22 is an example in which the amount of Cr is less than 0.1% which is the lower limit of the amount of Cr. Since a sufficient amount of Cr to secure hardenability was not contained, the tensile strength of the base metal did not satisfy the acceptance criteria. The steel plate of Test No. 23 is an example in which the amount of Cr is more than 1.5% which is the upper limit of the amount of Cr. In this case, hardenability was excessively increased, and thus the impact absorbed energy of the base metal and the δc of the weld heat affected zone of the steel plate of Test No. 23 did not satisfy the acceptance criteria. Furthermore, since Cr is an element which facilitates SR embrittlement, in the steel plate of Test No. 23, the $\Delta vTrs_{BM}$ was more than 0° C.

The steel plates of Test Nos. 24 and 25 are examples in which the amount of Mo is out of the specified range of the present invention. The steel plate of Test No. 24 is an example in which the amount of Mo is less than 0.1% which is the lower limit of the amount of Mo. As a result, an increase in hardenability and precipitation strengthening during tempering could not be applied, and thus the tensile strength of the base metal did not satisfy the acceptance criteria. The steel plate of Test No. 25 is an example in which the amount of Mo is more than 1% which is the upper limit of the amount of Mo. Since precipitation strengthening during tempering is significant, the yield strength and the tensile strength of the base metal did not satisfy the acceptance criteria. In addition, due to an increase in hardenability, the impact absorbed energy and the CTOD properties of the weld heat affected zone did not satisfy the acceptance criteria. In addition, an excessive addition of Mo causes embrittlement due to excessive precipitation of Mo carbides during SR. Therefore, in the steel plate of Test No. 25, the $\Delta vTrs_{BM}$ was more than 0° C.

The steel plates of Test Nos. 26 and 27 are examples in which the amount of V is out of the specific range of the present invention. The steel plate of Test No. 26 is an example in which the amount of V is less than 0.005% which is the lower limit of the amount of V. In this case, hardenability was decreased, and thus the tensile strength of the base metal did not satisfy the acceptance criteria. On the contrary, Test No. 27 is an example in which the amount of V is more than 0.07% which is the upper limit of the amount of V. Due to an excessive increase in hardenability, the impact absorbed energy of the weld heat affected zone was slightly low, and the δc of the weld heat affected zone did not satisfy the acceptance criteria.

The steel plates of Test Nos. 28 and 29 are examples in which the amount of Al is out of the specified range of the present invention. The steel plate of Test No. 28 is an example in which the amount of Al is less than 0.01% which is the lower limit of the amount of Al. The amount of N being solutionized was reduced and hardenability due to B could not be sufficiently applied. Therefore, the hardenability was reduced, and the yield strength and the tensile strength of the base metal and the impact absorbed energy of the heat affected zone did not satisfy the acceptance criteria. Furthermore, in the steel plate of Test No. 28, the average grain size of the base metal was out of the specified range of the present invention. This is because, in a case where the amount of Al is low, the amount of AlN which has a function of refining the structure is reduced, and the grain size is increased. Accordingly, in the steel plate of Test No. 28, the $\Delta vTrs_{BM}$ was more than 0° C. The steel plate of Test No. 29 is an example in which the amount of Al is more than 0.1% which is the upper limit of the amount of Al. Coarse precipitates and oxides were generated, and thus the impact absorbed energy and the δc of the weld heat affected zone did not satisfy the acceptance criteria.

The steel plates of Test Nos. 30 and 31 are examples in which the amount of B is out of the specified ranged of the present invention. The steel plate of Test No. 30 is an example in which the amount of B is less than 0.0005% which is the lower limit of the amount of B. Since hardenability due to B could not be sufficiently obtained, the yield strength and the tensile strength of the base metal and the impact absorbed energy of the base metal did not satisfy the acceptance criteria. In addition, in the steel plate of Test No. 30, the average grain size of the base metal was out of the specified range of the present invention. This is because, in a case where the amount of B is too low, the hardenability of the steel is reduced, and the structure becomes coarsened after quenching. Accordingly, in the steel plate of Test No. 30, the $\Delta vTrs_{BM}$ also did not satisfy the acceptance criteria. The steel plate of Test No. 31 is an example in which the amount of B is more than 0.002% which is the upper limit of the amount of B. Coarse B carbides and the like were precipitated due to the excessive amount of B, the hardenability was reduced. Therefore, the tensile strength and the toughness (impact absorbed energy) of the base metal did not satisfy the acceptance criteria. In addition, in the steel plate of Test No. 31, the average grain size of the base metal was out of the specified range of the present invention. This is because even in a case where the amount of B is too high, the hardenability of the steel is reduced, and the structure becomes coarsened after quenching. Accordingly, in the steel plate of Test No. 31, the $\Delta vTrs_{BM}$ was also more than 0° C.

The steel plates of Test Nos. 32 and 33 are examples in which the amount of N is out of the specified ranged of the present invention. The steel plate of Test No. 32 is an example in which the amount of N is less than 0.002% which is the lower limit of the amount of N. In this case, fine precipitates of aluminum nitrides which are necessary for reducing the grain size of the base metal during heating for quenching could not be obtained, and thus the average grain size of the base metal was out of the specified range of the present invention. Accordingly, the impact absorbed energy of the base metal, the impact absorbed energy of the weld heat affected zone, and the SR embrittlement degree $\Delta vTrs_{BM}$ of the base metal did not satisfy the acceptance criteria. The steel plate of Test No. 33 is an example in which the amount of N is more than 0.01% which is the upper limit of the amount of N. As a result, the amount of N being solutionized was increased during quenching and thus the amount B being solutionized to enhance hardenability was nitrified and lost. Therefore, hardenability was reduced, and the yield strength, the tensile strength, the impact absorbed energy of the base metal did not satisfy the acceptance criteria.

The steel plate of Test No. 34 is an example in which the amount of Cu which is a selective element is more than the upper limit of the amount of C. In this case, precipitation strengthening of Cu had occurred during tempering, and thus the yield strength, the tensile strength, the impact absorbed energy of the base metal did not satisfy the acceptance criteria.

Furthermore, the steel plates of Test Nos. 35, 36, and 37 are examples in which the amount of each element is within the specified range of the present invention but any one of the α value and the β value is out of the specified range of the present invention. The steel plate of Test No. 35 is an example in which the α value is more than 1.00 mass % which is the upper limit of the α value. The toughness of the weld heat affected zone after SR was reduced, and thus the impact absorbed energy of the weld heat affected zone was low and the δc of the weld heat affected zone did not satisfy the acceptance criteria. The steel plate of Test No. 36 is an example in which the β value is less than 8.45 which is the lower limit of the β value. In this case, a dense lower bainite structure which was generated during cooling after welding could not be sufficiently secured. As a result, the toughness of the weld heat affected zone was reduced, and thus the δc of the weld heat affected zone did not satisfy the acceptance criteria. The steel plate of Test No. 37 is an example in which the β value is more than 15.2 which is the upper limit of the β value. In this case, a large amount of the martensite structure which has a lower toughness than that of the lower bainite structure and is thus hard was generated during cooling for welding, and thus the toughness and the δc of the weld heat affected zone did not satisfy the acceptance criteria.

The steel plates of Test Nos. 38 and 39 are examples in which both the α value and the β value are out of the specified range of the present invention. The steel plate of Test No. 38 is an example in which the α value is more than the upper limit thereof and the β value is less than the lower limit thereof. In this case, toughness after SR is reduced, and thus the δc did not satisfy the acceptance criteria. The steel plate of Test No. 39 is an example in which both the α value and the β value are more than the upper limit. In this case, hard martensite generated due to welding became further embrittled by SR. Therefore, the toughness of the weld heat affected zone was slightly reduced, and the impact absorbed energy and the δc of the weld heat affected zone did not satisfy the acceptance criteria.

Next, in order to check the effect of an average grain size on SR embrittlement degree of the base metal, steel plates of Test Nos. X1 to X10 which will be described as follows were produced.

As shown in Table 3, the steel plates of Test Nos. X1 to X3 were made of the steel A5 shown in Table 1-1, the steel plates of Test Nos. X4 to X6 were made of the steel A8, and the steel plates of Test Nos. X7 to X10 were made of the steel A9. During the manufacturing, slabs were heated under the condition of a heating temperature of 1050 to 1300° C., and were hot-rolled under the condition of a rolling reduction of 10 to 70%. Thereafter, air cooling was performed to reach 100° C. or less, or water cooling was performed to reach 100° C. or less. Thereafter, a typical quenching treatment and a tempering treatment were performed on the steel plates other than the steel plates of Test Nos. X4 and X6. In the steel plates of Test Nos. X4 and X6, water cooling treatment was performed immediately after the hot rolling such that the quenching was omitted and only the tempering treatment was performed. In a case where the direct quenching treatment was performed, a cooling start temperature after the rolling was set to an Ar3 point or higher, and water cooling was performed to reach 300° C. or less. The average cooling rate during the water cooling was 5° C./s or more.

The charpy transition temperature (vTrs) of each of the steel plates obtained as described above was measured. Thereafter, SR was performed on each of the steel plates, and the charpy transition temperature of each of the steel plates after SR was measured. In SR, a holding temperature was 560° C., and a rate of temperature increase within a temperature range of 425° C. or more and a rate of temperature decrease within the temperature range of 425° C. or more were 55° C./hour or less. In SR, a holding time was t/25 hours in a case of a plate thickness of t≥50 mm, and was 2 hours in a case of a plate thickness of t<50 mm. The charpy transition temperatures before and after SR were obtained by collecting charpy impact test specimens from each of the steel plates on the basis of JIS Z 2242 and then conducting the charpy impact test to the test specimens. In addition, the $\Delta vTrs_{BM}$ of each of the steel plates was obtained by subtracting the charpy transition temperature of the base metal after SR from the charpy transition temperature of the base metal before SR.

TABLE 3

| | | METHOD FOR MANUFACTURING STEEL SHEET | | | | | | PROPERTIES OF BASE METAL (AT THICKNESS CENTER) | |
|---|---|---|---|---|---|---|---|---|---|
| TEST NO. | STEEL | HEATING TEMPERATURE (° C.) | REDUCTION (%) | COOLING TO 100° C. AFTER ROLLING | QUENCHING TEMPERATURE (° C.) | TEMPERING TEMPERATURE (° C.) | PLATE THICKNESS (mm) | AVERAGE GRAIN SIZE (μm) | $\Delta vTrs_{BM}$ (° C.) |
| X1 | A5 | 1150 | 50 | AIR COOLING | 910 | 620 | 95 | 21 | −10 |
| X2 | A5 | 1150 | 50 | AIR COOLING | 940 | 620 | 95 | 37 | 1 |
| X3 | A5 | 1150 | 50 | AIR COOLING | 960 | 620 | 95 | 51 | 5 |
| X4 | A8 | 1050 | 70 | WATER COOLING | — | 620 | 25 | 18 | −14 |
| X5 | A8 | 1300 | 65 | WATER COOLING | — | 620 | 25 | 38 | 6 |
| X6 | A8 | 1150 | 35 | WATER COOLING | — | 620 | 25 | 42 | 4 |
| X7 | A9 | 1250 | 50 | AIR COOLING | 930 | 620 | 150 | 24 | −5 |
| X8 | A9 | 1300 | 50 | AIR COOLING | 930 | 620 | 150 | 41 | 7 |
| X9 | A9 | 1250 | 50 | AIR COOLING | 960 | 620 | 150 | 62 | 12 |
| X10 | A9 | 1250 | 10 | AIR COOLING | 930 | 620 | 150 | 39 | 5 |

In the steel plates of Test Nos. X1, X4, and X7, the manufacturing conditions were appropriate, and thus the average grain size of the base metal was 35 μm or less and the $\Delta vTrs_{BM}$ was 0° C. or less.

In the steel plates of Test Nos. X2, X3, and X9, the quenching temperature was higher than 930° C., and thus the average grain size of the base metal was more than 35 μm and the $\Delta vTrs_{BM}$ was more than 0° C. In the steel plates of Test Nos. X5 and X8, the heating temperature before the hot rolling was higher than 1250° C., and thus the average grain size of the base metal was more than 35 μm and the $\Delta vTrs_{BM}$ was more than 0° C. In the steel plates of Test Nos. X6 and X10, the rolling reduction during the hot rolling was less than 50%, and thus the average grain size of the base metal was more than 35 μm and the $\Delta vTrs_{BM}$ was more than 0° C.

The invention claimed is:

1. A steel plate having a chemical composition comprising, in terms of mass %:

C—: 0.07 to 0.10%;
Si—: 0.01 to 0.10%;
Mn—: 0.5 to 1.5%;
Ni—: 0.5 to 3.5%;
Cr—: 0.1 to 1.5%;
Mo—: 0.1 to 1.0%;
V—: 0.005 to 0.070%;
Al—: 0.01 to 0.10%;
B—: 0.0005 to 0.0020%;
N—: 0.002 to 0.010%;
P—: 0.006% or less;
S—: 0.003% or less;
Cu—: 0 to 1%;
Nb—: 0 to 0.05%;
Ti—: 0 to 0.020%;
Ca—: 0 to 0.0030%;
Mg—: 0 to 0.0030%;
REM-: 0 to 0.0030%; and
the remainder including Fe and impurities,
wherein
an α value defined by Expression 1 is 0.13 to 1.0 mass %,
a β value defined by Expression 2 is 8.45 to 15.2,
a yield strength is 670 to 870 N/mm$^2$,
a tensile strength is 780 to 940 N/mm$^2$,
a grain is defined as an area surrounded by a boundary in which a misorientation is 30° or more and which is identified by performing an orientation analysis using an electron beam backscatter diffraction pattern analysis method,
a grain size is defined as an equivalent circle diameter of the grain, an average grain size is defined as a grain size at which a cumulative frequency is 90% when a frequency distribution of the grain size is cumulated from a small grain size side,
the average grain size at mid-thickness of the steel plate is 35 μm or less, and
a plate thickness is 25 to 200 mm, and
wherein $$\alpha = C + 6 \times Si + 100 \times P \quad \text{Expression 1}$$

$$\beta = 0.65 \times C^{1/2} \times (1 + 0.64 \times Si) \times (1 + 4.10 \times Mn) \times (1 + 0.27 \times Cu) \times (1 + 0.52 \times Ni) \times (1 + 2.33 \times Cr) \times (1 + 3.14 \times Mo) \quad \text{Expression 2, and}$$

C, Si, P, Mn, Cu, Ni, Cr, and Mo indicate the amounts of C, Si, P, Mn, Cu, Ni, Cr, and Mo in terms of mass %, respectively.

2. The steel plate according to claim 1, wherein the chemical composition includes, in terms of mass %:

Mn—: 0.7 to 1.2%;
Ni—: 0.8 to 2.5%;
Cr—: 0.5 to 1.0%;
Mo—: 0.35 to 0.75%;
V—: 0.02 to 0.05%;
Al—: 0.04 to 0.08%; and
Cu—: 0.2 to 0.7%.

3. The steel plate according to claim 1, wherein the plate thickness of the steel plate is 50 to 150 mm.

4. The steel plate according to claim 1, wherein
when a stress relief annealing is performed on the steel plate with a holding temperature of 560° C., a holding time of h hours defined by Expression 3 and Expression 4, a rate of temperature increase within a temperature range of 425° C. or more of 55° C./hour or less, and a rate of temperature decrease within the temperature range of 425° C. or more of 55° C./hour or less, a Charpy absorbed energy at −40° C. is 100 J or more, when $t \geq 50$, $h = t/25$ Expression 3, when $t < 50$, $h = 2$ Expression 4, and t indicates the plate thickness of the steel plate in terms of mm and h indicates the holding time in unit of hour.

5. The steel plate according to claim 2, wherein the plate thickness of the steel plate is 50 to 150 mm.

6. The steel plate according to claim 1, wherein the chemical composition includes, in terms of mass %:

Mn: 0.5 to 0.88%.

* * * * *